US011565370B2

(12) United States Patent
Bosio et al.

(10) Patent No.: US 11,565,370 B2
(45) Date of Patent: Jan. 31, 2023

(54) METHOD AND APPARATUS FOR CARRYING OUT THE REPLACEMENT OF AN ABRASIVE ELEMENT IN A MACHINE FOR WORKING SURFACES

(71) Applicant: FABRICA MACHINALE S.R.L., Cascina (IT)

(72) Inventors: Luca Bosio, Pisa (IT); Luca Ferretti, Pisa (IT); Renzo Valleggi, Cascina (IT)

(73) Assignee: FABRICA MACHINALE S.R.L., Cascina (IT)

( * ) Notice: Subject to any disclaimer, the term of this patent is extended or adjusted under 35 U.S.C. 154(b) by 246 days.

(21) Appl. No.: 16/771,047

(22) PCT Filed: Dec. 19, 2018

(86) PCT No.: PCT/IB2018/060334
§ 371 (c)(1),
(2) Date: Jun. 9, 2020

(87) PCT Pub. No.: WO2019/123310
PCT Pub. Date: Jun. 27, 2019

(65) Prior Publication Data

US 2021/0178549 A1 Jun. 17, 2021

(30) Foreign Application Priority Data

Dec. 20, 2017 (IT) ..... 102017000147263

(51) Int. Cl.
*B24B 45/00* (2006.01)
*B24D 9/08* (2006.01)

(52) U.S. Cl.
CPC ..... *B24B 45/006* (2013.01); *B24D 9/085* (2013.01)

(58) Field of Classification Search
CPC ..... B24B 45/006; B24B 49/12; B24B 49/16; B24B 53/017; B24B 53/02; B24B 47/10; B24B 45/003; B24D 9/085
(Continued)

(56) References Cited

U.S. PATENT DOCUMENTS 3,028,770 A * 4/1962 Pittwood ..... B23B 47/00 409/207
3,562,968 A 2/1971 Johnson et al.
(Continued)

FOREIGN PATENT DOCUMENTS

DE 10 2016 106 141 A1 10/2017
EP 1795301 A1 * 6/2007 ..... B24B 23/02
(Continued)

OTHER PUBLICATIONS

International Search Report, dated Jun. 7, 2019, corresponding to International Application No. PCT/IB2018/060334.

*Primary Examiner* — Joseph J Hail
*Assistant Examiner* — Caleb Andrew Holizna
(74) *Attorney, Agent, or Firm* — Ladas & Parry LLP; Malcolm J. MacDonald

(57) ABSTRACT

An apparatus (1) for carrying out the replacement of an abrasive element (20) in a machine (100) for finishing surfaces, comprises a support body (10) configured to reversibly engage the abrasive element (20). The support body (10) and the abrasive element (20) provide, at respective engagement surfaces (15,25), mutual engagement members of removable type (16,26) configured to move from an engagement position to a disengagement position by rotating about a rotational axis (110) in a first sense of rotation e, from the disengagement position to the engagement position, by rotating about the rotational axis (110) in a second sense of rotation opposite to the first one. The apparatus furthermore, comprises a displacement device
(Continued)

(40) for moving the support body (10) in the space according to at least 1 degree of freedom. The apparatus (1), furthermore, provides at least a removal station (101) for removing an abrasive element (20) from the support body (10), or at least an application station (102) for engaging an abrasive element (20) to the support body (10).

15 Claims, 14 Drawing Sheets

(58) Field of Classification Search
USPC ..... 451/56, 5–6, 8–9, 72, 443, 280, 294, 451/360–363, 509–510
See application file for complete search history.

(56) References Cited

U.S. PATENT DOCUMENTS

| | | | | |
|---|---|---|---|---|
| 2015/0044948 | A1 | 2/2015 | Kottbus et al. | |
| 2019/0152015 | A1* | 5/2019 | Naderer | B24B 27/0038 |

FOREIGN PATENT DOCUMENTS

| | | | |
|---|---|---|---|
| GB | 2047133 | A1 | 11/1980 |
| WO | 2015/125068 | A1 | 8/2015 |

* cited by examiner

METHOD AND APPARATUS FOR CARRYING OUT THE REPLACEMENT OF AN ABRASIVE ELEMENT IN A MACHINE FOR WORKING SURFACES

FIELD OF THE INVENTION

The present invention relates to the technical field of machines for working surfaces that are able to move an abrasive element in the space according to at least 2 degrees of freedom, and in particular the invention relates to an apparatus for carrying out the replacement of the abrasive element.

Furthermore, the invention refers to a method for carrying out the above mentioned replacement.

DESCRIPTION OF THE PRIOR ART

As known, in order to carry out the operations for finishing surfaces made of pottery, wood, plastic materials, metallic materials, etc. in order to improve their shape, the measurement accuracy and the tribological properties, lapping machines, or sanding machines, equipped with an abrasive element, typically an abrasive disc, are commonly used.

In particular, the lapping, or sanding, operations are normally carried out manually by an operator who grasps a manual lapping, or sanding machine, and moves the abrasive disc with respect to the surface to be worked. More precisely, in the machines of known type, the abrasive disc is engaged to a support normally called "backing pad", which is moved by an electric motor, or a compressed air motor. Normally a distinction is made between orbital lapping machines, in which the abrasive element is moved, by the backing pad, in such a way to produce circular movements more, or less wide, and roto-orbital lapping machines, in which a rotational movement is added to the orbital movement. In this way, it is possible to obtain a finishing of the working surfaces of a higher quality.

In addition to the manual machines, automatic industrial machines are also known in which the abrasive disc is moved with respect to the surface to be worked by an anthropomorphic arm, or however, by means of a support mounted on guides, in such a way to move the abrasive element according at least two different directions of movement.

The abrasive element can be engaged to the backing pad, or more in general to the support, in different ways, for example by means of Velcro, or adhesive tape, or by means of a threaded connection. Normally, the threaded connection is provided between a threaded blind hole made in the support, and a threaded shaft of which the abrasive element is provided at the face opposite to the face that, in working conditions, exerts the abrasive action. A very common type of threaded connection between support and abrasive disc, usually known in the technical field as "ROLOC" system, is, for example, described in U.S. Pat. No. 3,562,968.

Both in case of hand machines, and in case of automatic machines, after a certain number of working cycles, it is, anyway, necessary to replace the abrasive element, which, unavoidably, during working operations wears out, and, therefore, is no more able to exert an effective abrasive action.

Normally, the replacement of the abrasive element is an operation that is carried out manually by an operator, with consequent loss of time, and productivity decreasing for the machine. Furthermore, the manual replacement of the abrasive element brings with it the risk to apply the new abrasive disc to the support in a wrong way, and therefore that, during the working operations, the abrasive disc can be removed from the correct position, thus compromising the whole operation.

In order to overcome the above disclosed drawbacks in WO2015/125068 an apparatus is provided that is able to automatically carry out the replacement of an abrasive element. In particular the solution described in WO2015/125068 provides a removal station where a removal device provided with a sharp edge works. Furthermore, a displacement device is provided for moving the support with respect to the removal device up to reach a removal position in which the sharp edge is interposed between the abrasive element and the support, thus causing the abrasive element to be removed from the support.

However, the solution according to WO2015/125068 even though highly effective if the abrasive element is fixed to the support by means of Velcro, or an adhesive layer, or similar fixing systems, does not seem to be suitable if the support and the abrasive element are mutually engaged by means of a threaded connection, that means in the case of the above mentioned ROLOC system.

Other examples of apparatuses for replacing an abrasive element in a machine for finishing surfaces are described in DE102016106141, DE102012006502 and GB2047133. However, the apparatuses described in these documents are not able to accurately and, at the same time, quickly remove a worn-out abrasive element and to apply a new one, in particular if the engagement elements engaging the abrasive element to the support moves from a mutual engagement configuration to a disengagement configuration by rotating one with respect to the other.

SUMMARY OF THE INVENTION

It is therefore an object of the present invention to provide an apparatus for replacing an abrasive element in machines for finishing surfaces, in particular lapping machines, sandpapering machines, or sanding machines, which allows to automate the replacement of the abrasive element if this is engaged to the support by a threaded connection.

It is also an object of the present invention to provide such an apparatus that is able to guarantee a highly accurate positioning of a new abrasive element at the support, or backing pad.

It is another object of the present invention to provide an apparatus that is able to increase the productivity of machines for finishing surfaces equipped with the above mentioned abrasive element.

It is still another object of the present invention to provide a method for replacing an abrasive element in machines for finishing surfaces, in particular lapping machines, sandpapering machines, or sanding machines, having the above disclosed advantages with respect to the prior art methods.

These and other objects are achieved by the apparatus, according to the invention, for carrying out the replacement of an abrasive element in a machine for finishing surfaces, said machine comprising:

- a support body configured to reversibly engage said abrasive element, said support body and said abrasive element providing, at respective engagement surfaces, mutual engagement members of removable type configured to move, from an engagement position to a disengagement position, by rotating about a rotational axis in a first sense of rotation and, from said disengagement position to said engagement position, by rotating about said rotational axis in a second sense of rotation opposite to the first one;

a displacement device configured to move said support body in the space according to at least 1 degree of freedom;

whose main characteristic is that said apparatus comprises at least a working station selected from the group consisting of:

a removal station in which a removal group is provided arranged to operate in combination with said displacement device for removing said abrasive element from said support body, said removal group and said displacement device configured to cause a relative rotation about said rotational axis in said first sense of rotation between said support body and said abrasive element, in such a way to cause said mutual engagement members to move from said engagement position to said disengagement position, said removal group providing a blocking device arranged to block one between said support body and said abrasive element, in a predetermined position during said relative rotation in said first sense of rotation;

an application station in which an engagement group is provided arranged to operate in combination with said displacement device in order to apply an abrasive element to said support body, said engagement group and said displacement device configured to cause a relative rotation of said support body and said abrasive element about said rotational axis in said second sense of rotation, in such a way to cause said mutual engagement members to move from said disengagement position to said engagement position, said engagement group providing a blocking device arranged to block one between said support body and said abrasive element in a predetermined position during said rotation in said second sense of rotation.

Further features of the invention and related embodiments are set out in the dependent claims.

According to another aspect of the invention, a method for applying, or removing, an abrasive element in a machine for finishing surfaces provides the steps of:

providing a support body configured to reversibly engage said abrasive element, said support body and said abrasive element providing, at respective engagement surfaces, mutual engagement members configured to move from an engagement position to a disengagement position by rotating in a first sense of rotation and, from said disengagement position to said engagement position, by rotating in a second sense of rotation opposite to the first one;

providing a displacement device configured to move said support body in the space according to at least 1 degree of freedom;

whose main characteristic is to provide at least one of the following steps:

a removal step for removing the abrasive element from the support body, said removal step being obtained blocking one between said support body and said abrasive element, and causing a relative rotation of said engagement surface of said support body and said engagement surface of said abrasive element in said first sense of rotation about said rotational axis, in such a way to cause said mutual engagement members to move from said engagement position to said disengagement position;

an application step for applying the abrasive element to the support body, said application step being obtained blocking one between said support body and said abrasive element and causing said relative rotation of said support body and said abrasive element in said second sense of rotation about said rotational axis, in such a way to cause said mutual engagement members to move from said disengagement position to said engagement position.

BRIEF DESCRIPTION OF THE DRAWINGS

The invention will now be shown with the following description of its exemplary embodiments, exemplifying but not limitative, with reference to the attached drawings in which.

Figure 1:
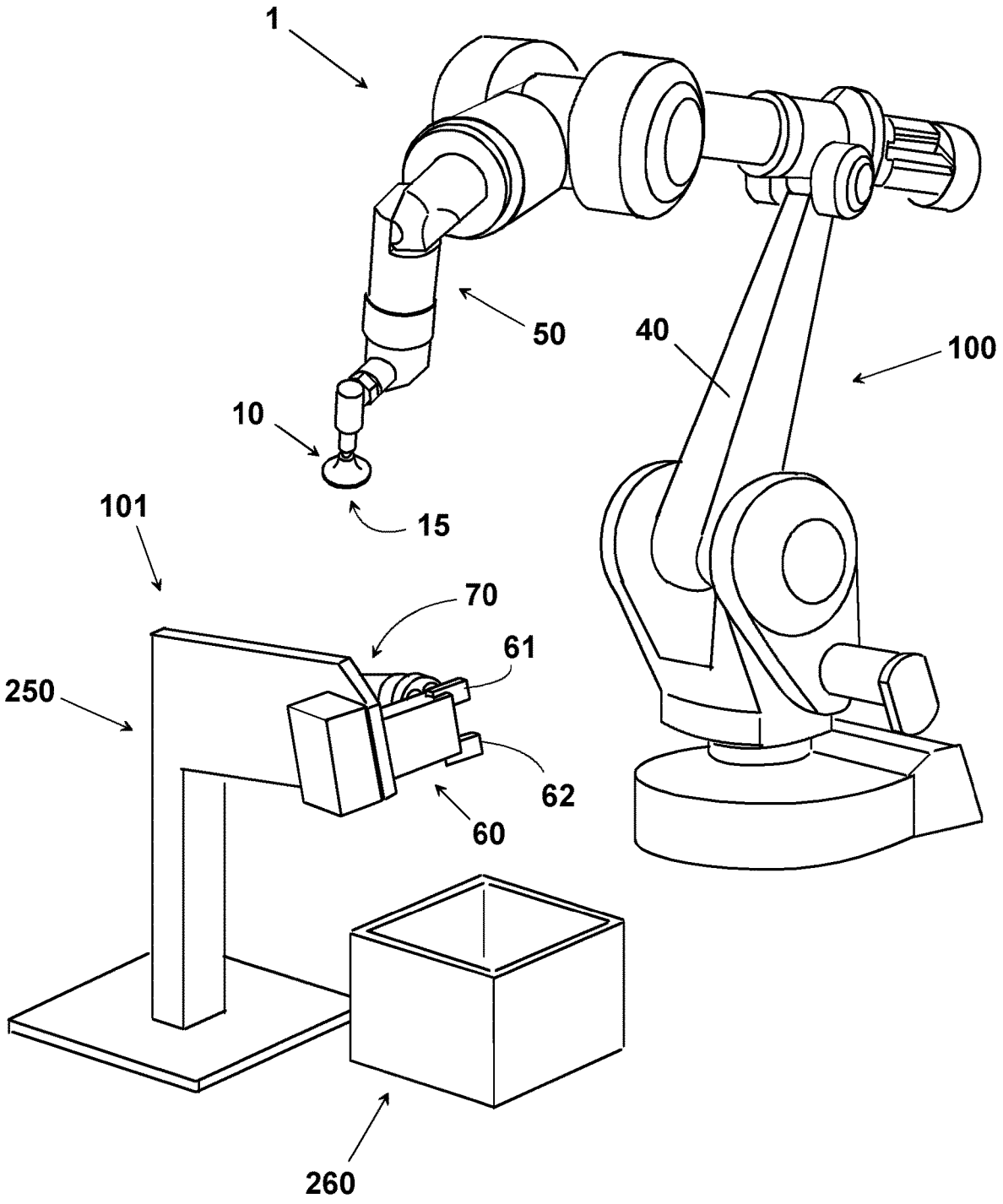
FIG. 1 diagrammatically shows a perspective side elevational view of a possible embodiment of an apparatus, according to the invention, for carrying out the replacement of an abrasive element in a machine for finishing surfaces.
Figure 8:
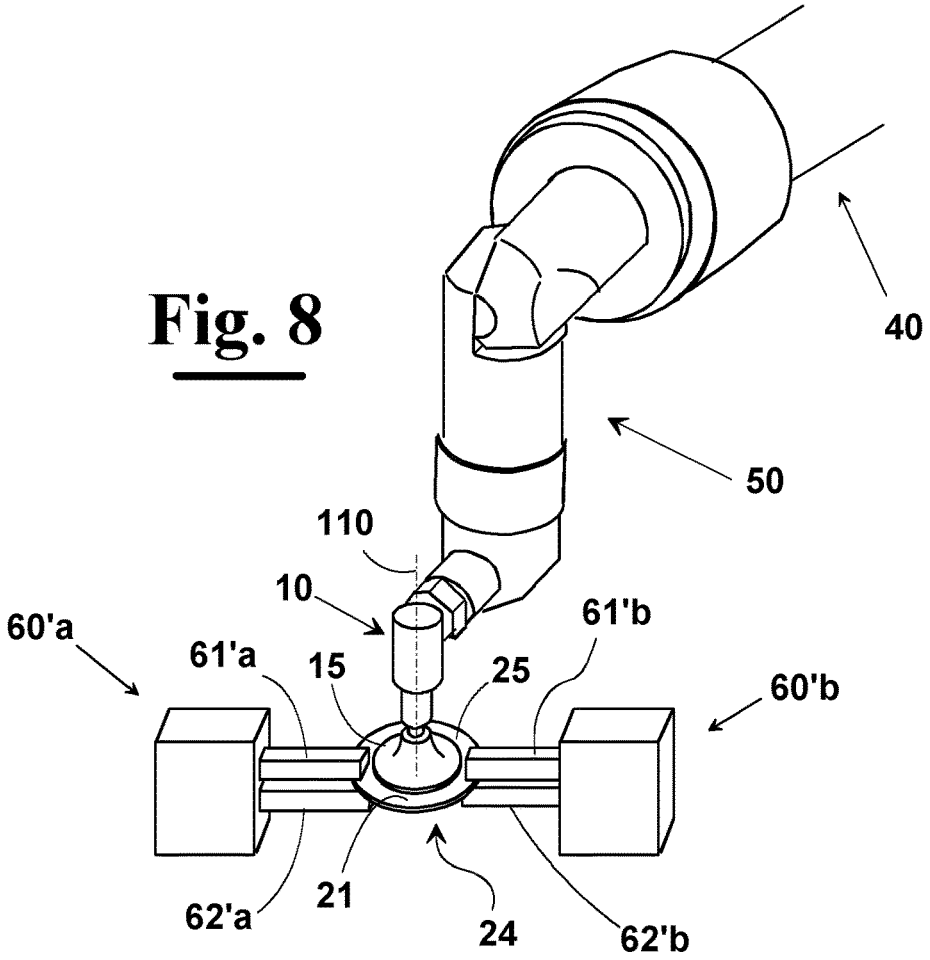
Figure 9:
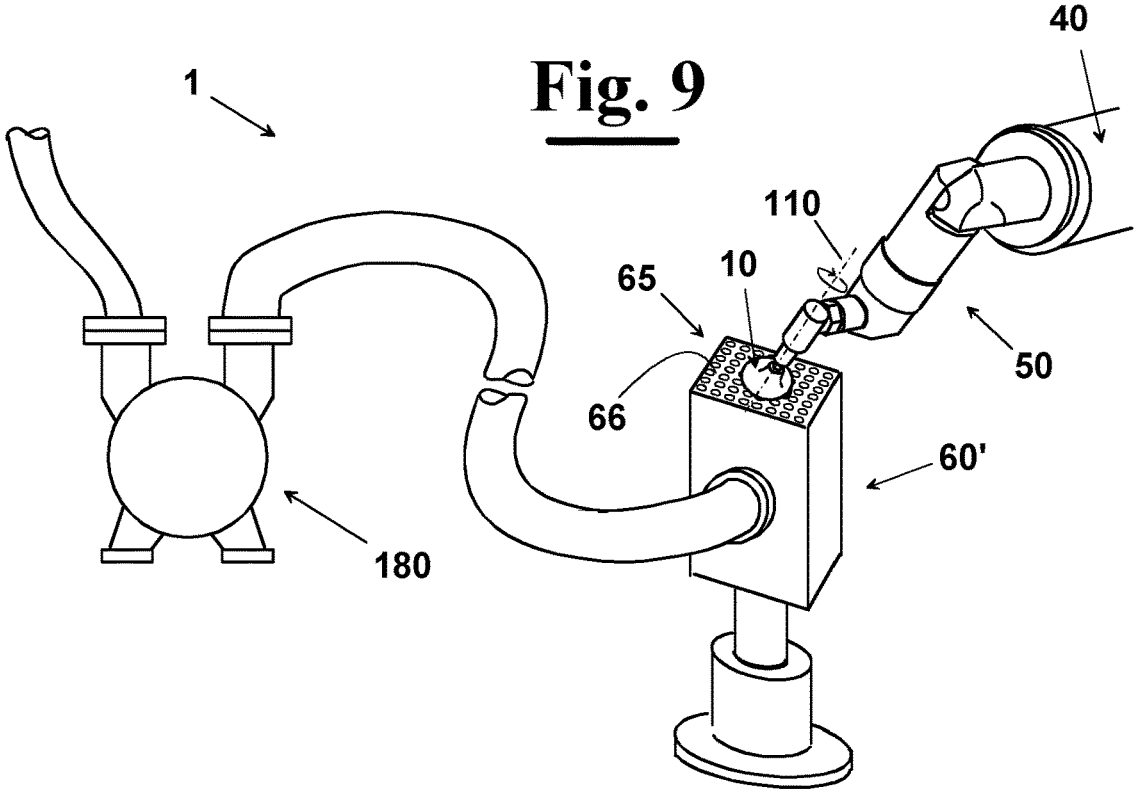
Figure 10:
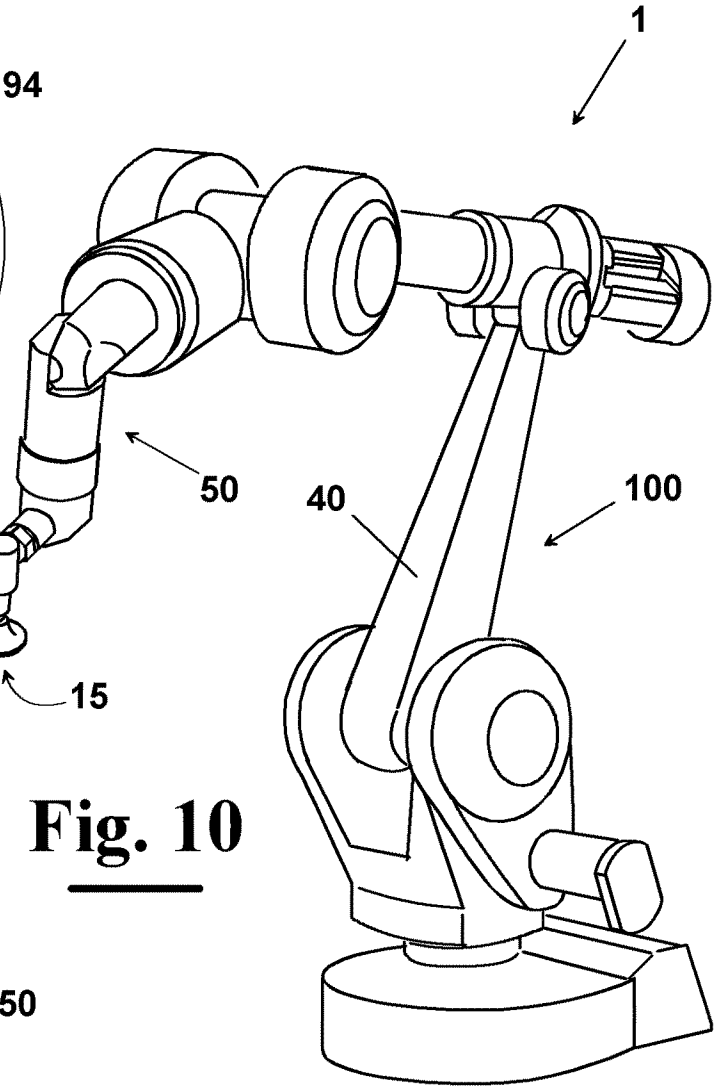
Figure 11:
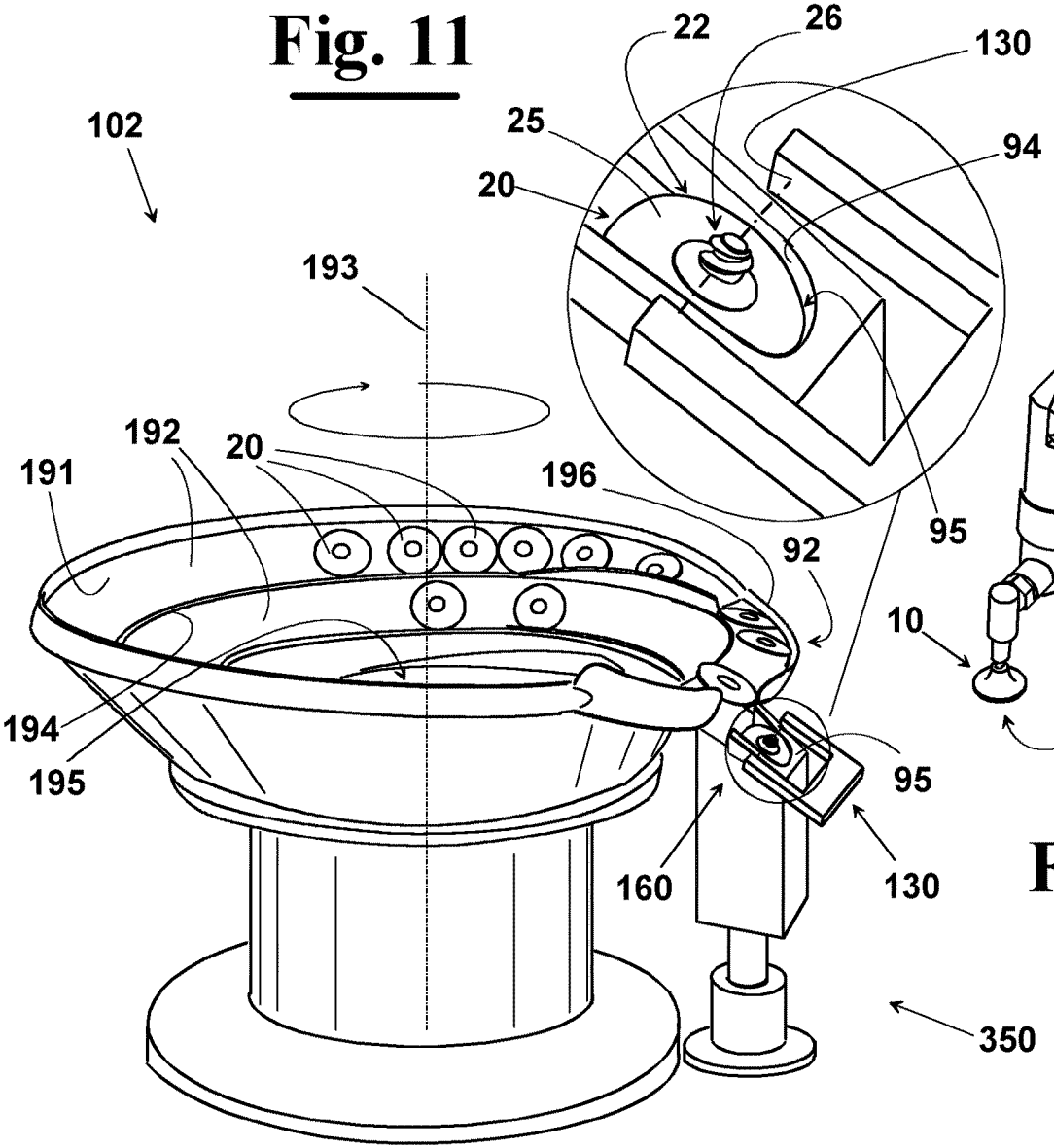
Figure 12:
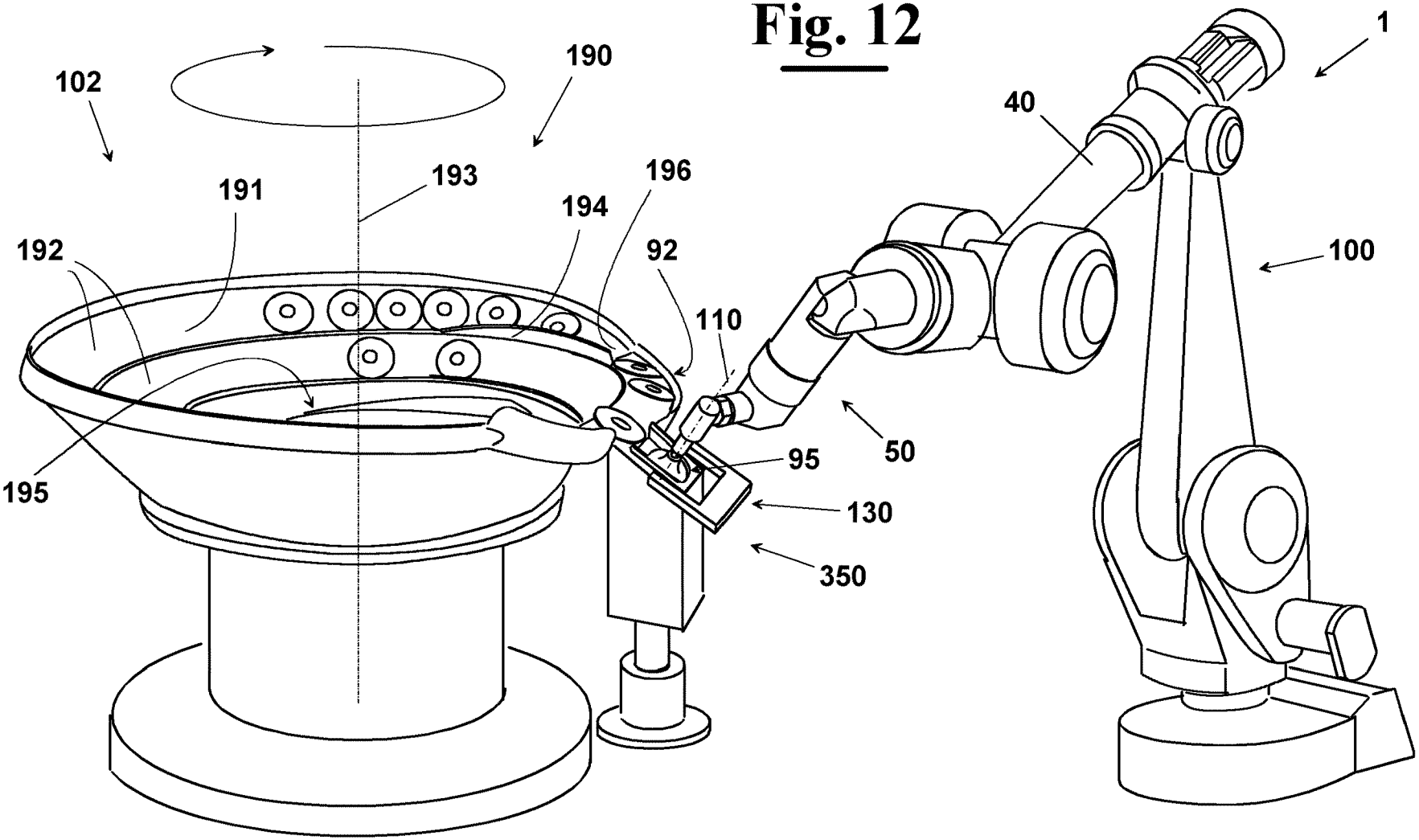
Figure 13:
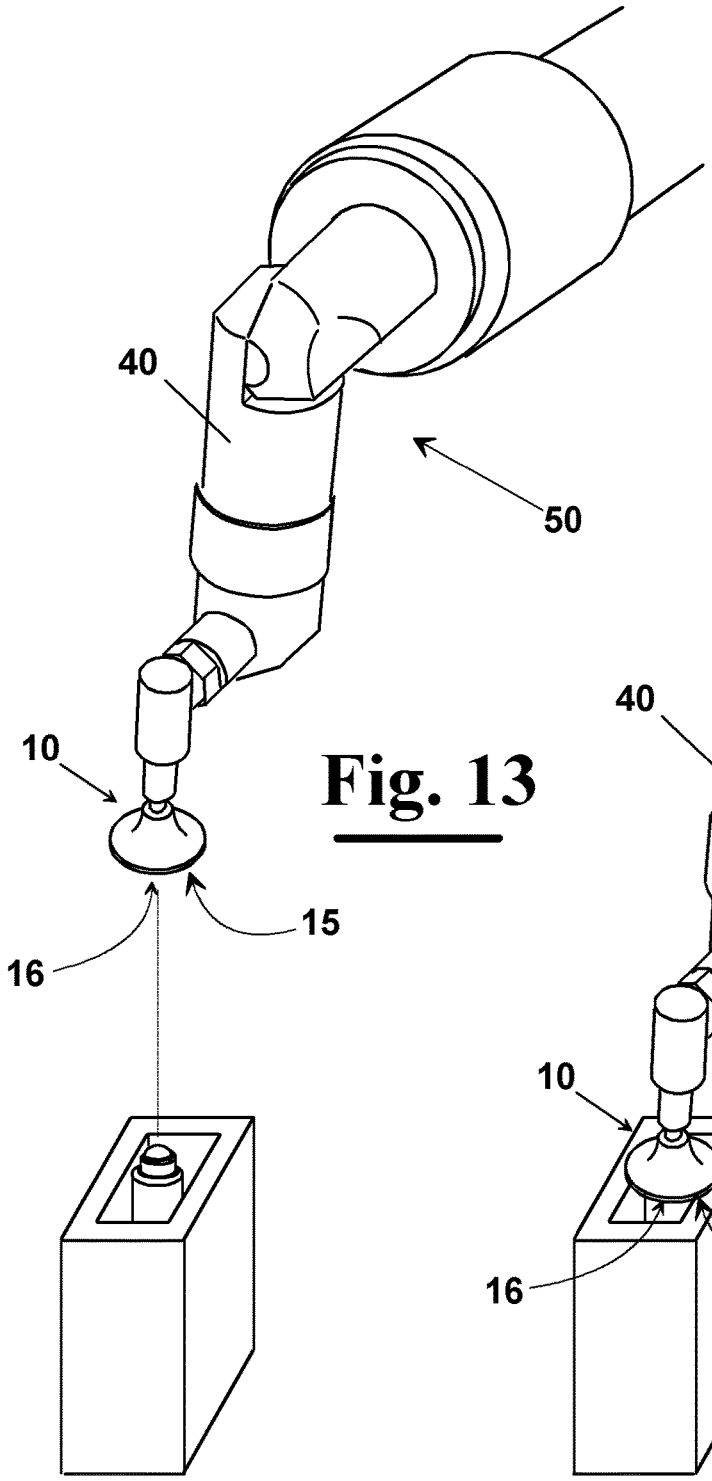
Figure 24:
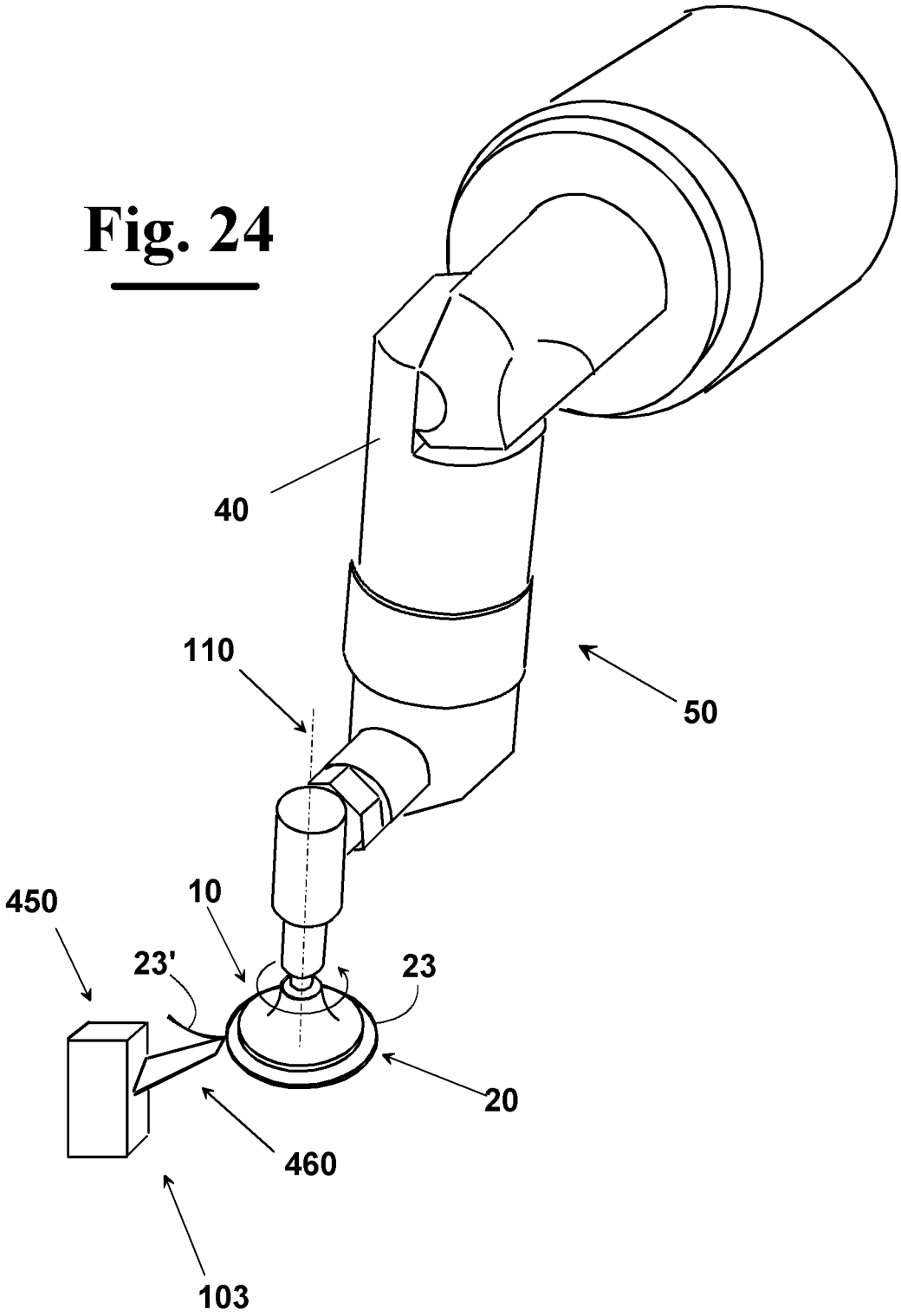

Figures from 2B to 2E show some possible embodiments of support body and of corresponding abrasive element that can be processed by the apparatus according to the invention;

Figures from 3 to 7 show a possible succession of steps through which is possible to remove the abrasive element from the support body by a first embodiment of the apparatus of FIG. 1;

FIG. 8 shows a perspective front elevational view of a possible embodiment of the blocking device according to the invention as an alternative to the embodiment shown in FIGS. 3 to 7;

FIG. 9 shows in a perspective side elevational view of another embodiment of the blocking device alternative to the embodiments shown in the FIGS. 3 to 7;

FIG. 10 diagrammatically shows a perspective side elevational view of an engagement group according to the invention for applying an abrasive element to the support body;

FIG. 11 shows an enlargement of a part of the engagement group of FIG. 10 in order to highlight some components provided in a possible embodiment of the engagement group;

FIG. 12 diagrammatically shows a perspective side elevational view of the instant in which the displacement device positions the support body at the application station;

Figures from 13 to 16 diagrammatically show a detection device according to the invention for detecting if any abrasive element is positioned, or not, on the engagement surface of the support body;

Figures from 17 to 18 diagrammatically show perspective side elevational views of possible embodiments of removal device of FIGS. 3-7;

Figures from 19 to 23 diagrammatically show a possible succession of steps through which it is possible to apply an abrasive element to the support body in an application station;

FIG. 24 shows a sharpening station according to an embodiment of the apparatus according to the invention.

DETAILED DESCRIPTION OF SOME EXEMPLARY EMBODIMENTS OF THE INVENTION

In FIG. 1, it is diagrammatically shown an apparatus 1, according to the invention, for replacing an abrasive element 20 in a machine for finishing surfaces, for example a lapping, or sanding machine 100. This comprises a working head 50 equipped with a support body 10 having an engagement surface 15 arranged to engage the engagement surface 25 of an abrasive element 20, this latter having an abrasive surface 24, which, in working conditions, is arranged at the opposite side to the engagement surface 25 for carrying out the lapping action on the worked surface. More precisely, the support body 10 and the abrasive element 20 provide, at the respective engagement surfaces 15 and 25, mutual engagement members 16 and 26 of removable type. These are configured to move from an engagement position, in which provide a connection between the abrasive element 20 and the support body 10, to a disengagement position in which the abrasive element 20 is disengaged from the support body 10.

More precisely, the above mentioned movement of the mutual engagement members 16 and 26 from the engagement position to the disengagement position is carried out by rotating one between the support body 10 and the abrasive element 20 in a first sense of rotation with respect to the other, about a rotational axis 110. Analogously, the mutual engagement members 16 and 26 are configured to move from the disengagement position to the above mentioned engagement position, by rotating one with respect to the other in a second sense of rotation, which is opposite to the first sense of rotation, about the rotational axis 110.

The finishing machine of surfaces 100, according to the invention, furthermore, comprises a displacement device 40 configured to move the support body 10 in the space according to at least 1 degree of freedom, in particular according to at least 2 degrees of freedom, more in particular according to at least 3 degrees of freedom, advantageously according to at least 4 degrees of freedom, preferably according to at least 5 degrees of freedom, for example according to 6 degrees of freedom. For example, as diagrammatically shown in FIG. 1, the displacement device 40 can be an anthropomorphic robot, having, for example 5, or 6 rotational degrees of freedom.

In particular, the displacement device 40 can be configured to cause at least a rotational motion of the support body 10 about the rotational axis 110 with respect to the working head 50. However, the possibility is not excluded that the finishing machine 100 can be of roto-orbital type and, therefore, that the displacement device 40 is configured to move the support body 10 in such a way that this describes an eccentric orbit with respect to the axis of working head 50.

According to the invention, the apparatus 1, in addition to the surfaces finishing machine 100, as above described, comprises at least a working station selected from the group comprising a removal station 101 for removing the worn-out abrasive element 20 from the support body 10, and an application station 101 for applying a new abrasive element 20 to the support body 10. In particular, the removal station 101 can be equipped with a removal group 250 arranged to operate in combination with the displacement device 40 in order to cause the above mentioned relative rotation between the support body 10 and the abrasive element 20 in the above mentioned first sense of rotation about the rotational axis 110, in such a way to cause the mutual engagement members 16 and 26 to move from the engagement position to the disengagement position. In particular, the removal group 250 is, furthermore, equipped with a blocking device 60 arranged to block the support body 10 in a predetermined position, during the above mentioned relative rotation in the first sense of rotation. Once removed, the abrasive element 20 can, for example, be stored in a tank 260.

In particular, the mutual engagement members 16 and 26 can comprise a threaded hole 16 at one between the engagement surface of the abrasive element and the support body, and a threaded shaft 26 at the other engagement surface. More in particular, the threaded hole 16 and the threaded shaft 26 are configured to carry out a threaded connection. Alternately, the mutual engagement members 16 and 26 can comprise a shaped shaft 26 at one between the engagement surface of the abrasive element and the support body, and a respective shaped hole 16 at the other engagement surface. Preferably, in this case, the shaped shaft 26 and the respective shaped hole 16 are configured to form a bayonet coupling.

In the embodiment of the invention that is diagrammatically shown in the figures from 3 to 7, as an example, the removal group 250 comprises a removal device 70 configured to cause, as above disclosed, the abrasive element 20 to rotate in the first sense of rotation, with respect to the support body 10, up to arrange the mutual engagement members 16 and 26 in the above mentioned disengagement position, for example to unscrew the threaded shaft 26 from the threaded hole 16, when the support body 10 is blocked by the blocking device 60. This can be a blocking device 60 external to the working head 50, as diagrammatically shown in the figures from 3 to 7, but also a device integrated in the working head 50, for example in the form of brake internal to the head same (case not shown in the figures for reasons of simplicity).

Still with reference to the figures from 3 to 7, the removal device 70 provides a transmission head 75 configured to be positioned, in use, in contact with the abrasive surface 24 of the abrasive element 20 in order to exert on the same a torque generated by a motor 80, in particular an electric motor. In this way, the above mentioned rotation of the abrasive element 20 is obtained in the first sense of rotation with respect to the support body 10.

Figure 17:
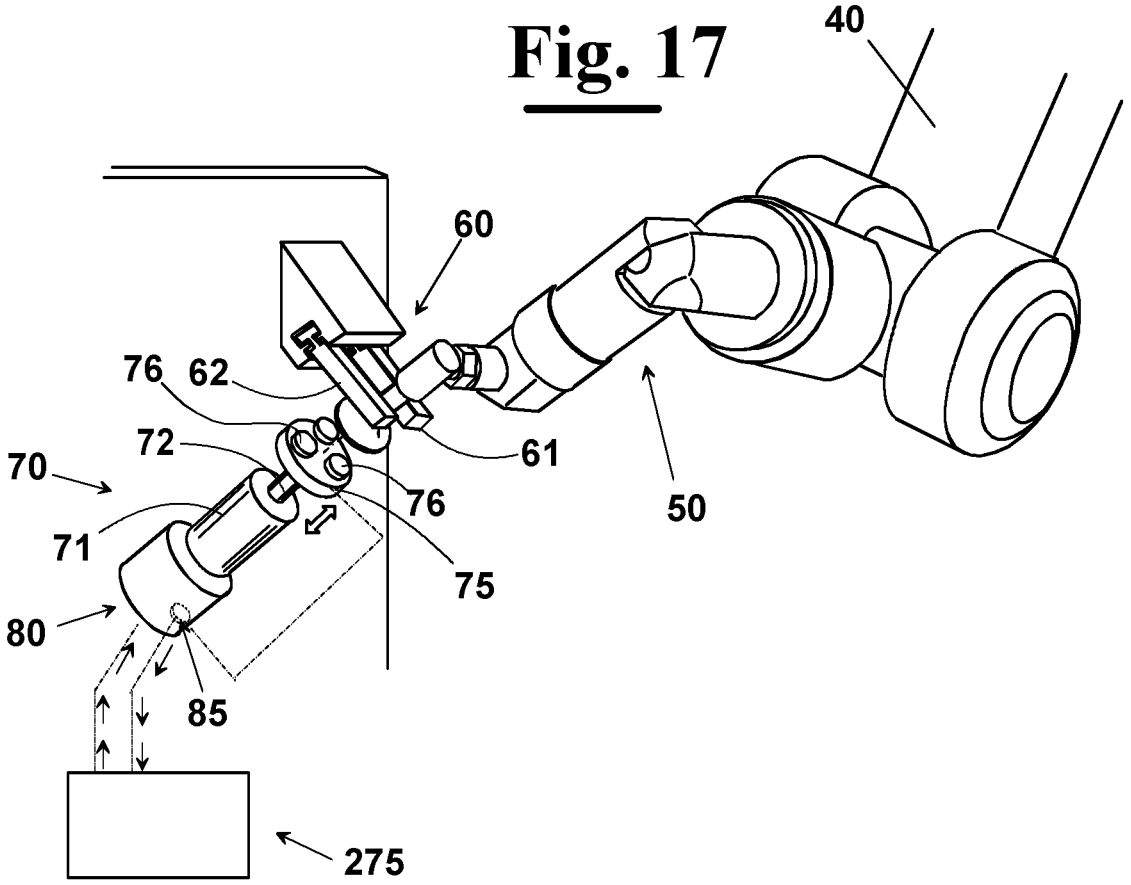
Figure 18:
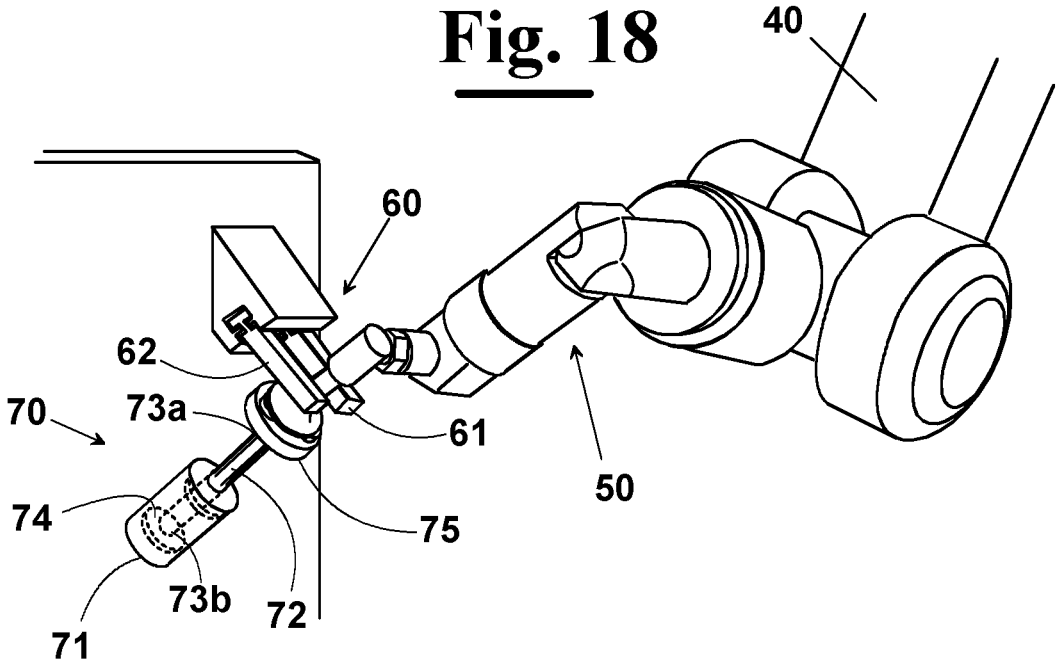

As diagrammatically shown in the FIGS. 17 and 18, transmission head 75 is, furthermore, advantageously mobile from/towards the blocking device 60. In this way it is possible to exert in a highly accurate way, and, in case, to control, the force applied on the abrasive element 20 in order to optimize the removal operation of the same from the support body 10. For example, a force sensor 85 can be provided associated to the removal device and configured to detect the force exerted by the transmission head 75 on the abrasive element 20. More in particular, force sensor 85 can send the detected value of force to a control unit 275, which can adjust motor 80 accordingly.

In an advantageous embodiment, the removal head 75 provides at least a transmission element 76, for example 3 transmission elements 76, in particular made of, or covered by, a material having a high friction coefficient, for example rubber. In this case, the torque is transmitted to the abrasive element 20, in particular to the abrasive surface 24 of the same, by the, or each, transmission element 76. As diagrammatically shown in FIG. 5, furthermore, the removal device 70 can provide a containment body 71 within which a sliding shaft 72 is mounted provided at an end 73*a* of transmission head 75, and, at the opposite end 73*b*, a sliding piston 74 operatively connected to the shaft of motor 80.

The blocking device 60 can comprise a first and a second tightening element 61 and 62 configured to move from a tightening position, in which they are close one to the other, and tighten the support body 10 between them, to a releasing position, in which they are far one from the other. For example, as shown in the figures from 3 to 7, the first and the second tightening elements 61 and 62 can move from the tightening position of FIG. 3, to the releasing position of FIG. 4, and vice versa, by rotating one with respect to the other. However it is also provided that the tightening elements 61 and 62 can move from the tightening position to the releasing position, and vice versa, by relatively rotating one with respect to the other, or any combination of movements.

As a skilled person in the art can easily understand, the above mentioned relative rotation of the support body 10 and the abrasive element 20 cause a corresponding axial translation. More precisely, the rotation in the above mentioned first sense of rotation causes the abrasive element 20 to move away from the support body 10, whilst a rotation in the above mentioned second sense of rotation causes a progressive approach of abrasive element 20 to the support body 10 up to position surface 25 adjacent to surface 15.

As diagrammatically shown in the FIGS. 8 and 9, in an alternative embodiment of the invention, the removal group 250 can provide a blocking device 60' configured to block the abrasive element 20 in a determined position. In this case, the displacement device 40 is advantageously configured to cause the support body 10 to rotate with respect to the abrasive element 20 when this latter is blocked by the blocking device 60'. The blocking device 60' can be, for example, pliers-shaped (FIG. 8). In this case, the surface of abrasive element 20 is, advantageously, higher the surface of support body 10, in such a way that the pliers blocking device 60' is able to engage the abrasive element 20 to a portion 21, which protrudes laterally from support body 10. For example, as diagrammatically shown in FIG. 8, a first and a second blocking device 60'*a* and 60'*b* can be provided arranged to tighten the protruding portion 21 at different points of the abrasive element 20. In particular, each blocking device 60'*a* and 60'*b* comprises a first and a second tightening element 61'*a*, 62'*a*, and 61'*b*, 62'*b*, each of which arranged to move from a spaced configuration to a tightening configuration, in which they tighten the protruding portion 21 of the abrasive element 20 between them.

In the alternative embodiment of FIG. 9, instead, the blocking device 60' comprises a perforated plate 65 at which the abrasive element 20 is positioned by the working head 50. In particular, the perforated plate 65 can be pneumatically connected to a vacuum generation system 180, which is operated to generate a determined vacuum degree at the suction surface 66 of the perforated plate 65 in such a way to suck the abrasive element 20, which is, therefore, blocked in a determined position, when the working head 50 provides to remove the same by causing the support body 10 to rotate about axis 110 in the first sense of rotation.

In addition to, or alternately, to the removal station 101 as above disclosed with reference to FIGS. 3 to 7, the apparatus 1, according to the invention, can provide an application station 102, at which a new abrasive element 20 can be applied on the support body 10. In particular, at the application station 102 an engagement group 350 can be provided arranged to operate in combination with the displacement device 40. More in particular, the engagement group 350 and the displacement device 40 are configured to cause at least the above disclosed relative rotation in the second sense of rotation between the support body 10 and the abrasive element 20 in order to cause the above disclosed movement of the mutual engagement members 16 and from the disengagement position to the engagement position, and to apply an abrasive element 20 on the engagement surface 15 of support body 10. More in particular, the engagement group 350 can provide a blocking device 160, or 160', arranged to block the support body 10, or the abrasive element 20, in a predetermined position during the above mentioned relative rotation in the second sense of rotation.

In the embodiment that is shown in the figures from 20 to 23, the engagement group 350 can provide an engagement device 170 configured to cause at least the above mentioned rotation of abrasive element 20 in the second sense of rotation, with respect to the support body 10, up to reach the mutual engagement members 16 and 26, from the disengagement position to the engagement position, when the blocking device 160 is arranged to block the support body 10 in a predetermined position.

In particular, the engagement group 350 provides a positioning device 90 configured to position an abrasive element 20 at a time, in a predetermined catching position 95. More in particular, the positioning device 90 is configured to position the abrasive element 20 at the catching position 95 in such a way that its abrasive surface 24 is exposed, or, as shown in the alternative embodiment of FIGS. 10 to 12, in such a way that the engagement surface 25 is exposed. In this last case the positioning device 90 is configured to position the abrasive element 20 in such a way that the threaded shaft 26 has a predetermined spatial orientation.

Figure 20:
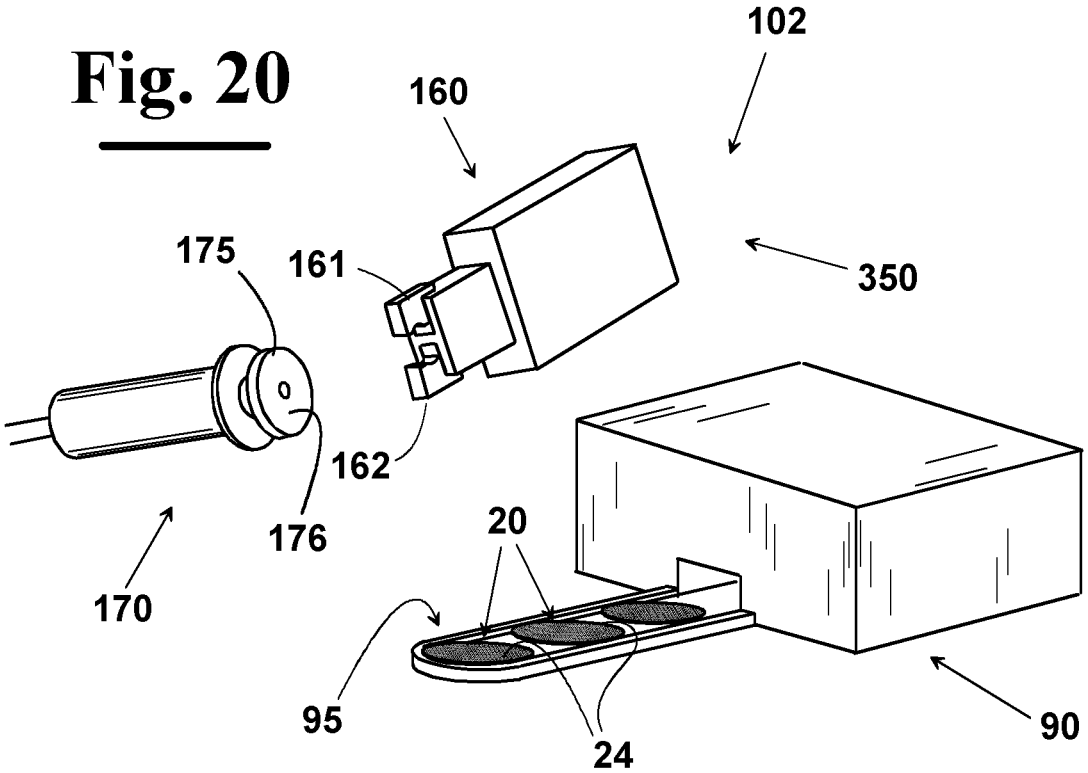
Figure 21:
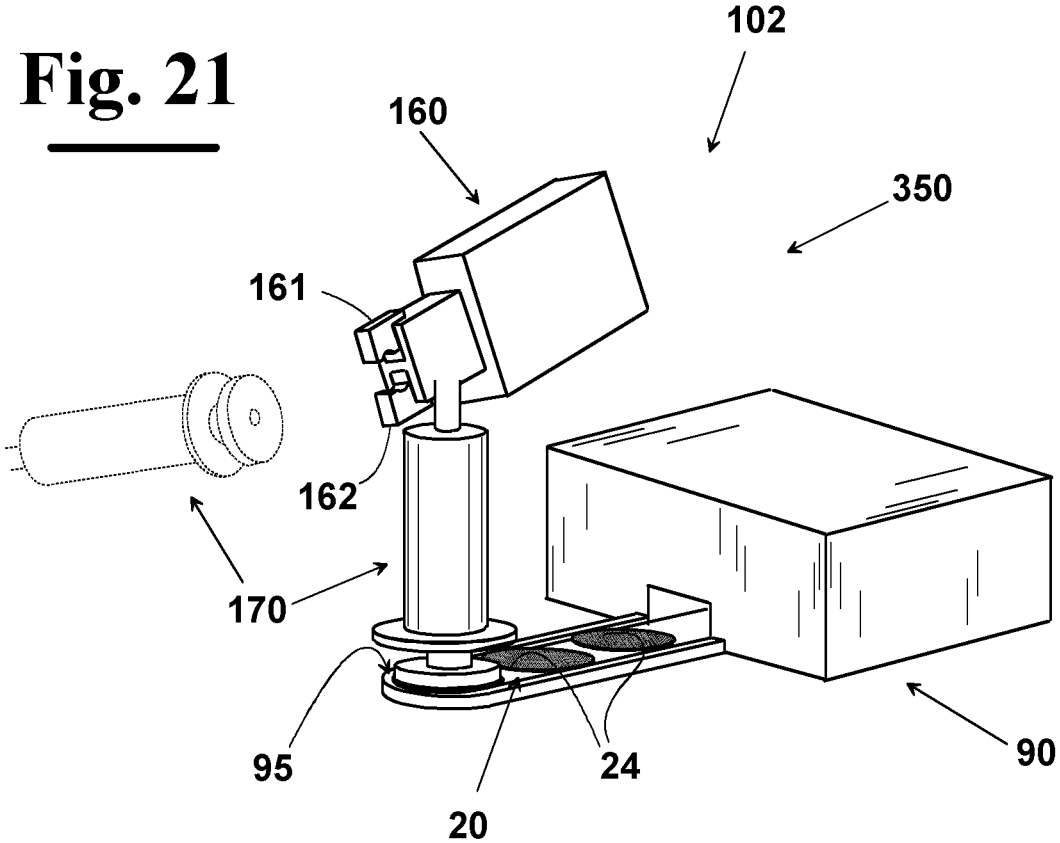

More in particular, in the case shown in the figures from 20 to 23, the abrasive element 20 at the catching position 95, is engaged by a catching head 175 of which the engagement device 170 is provided of. The engagement device can, for example, move from the neutral position of FIG. 20 to the catching position of FIG. 21 by rotating, or translating, or any combination of movements, carried out by an operation device not shown in the figure for reasons of simplicity.

Figure 22:
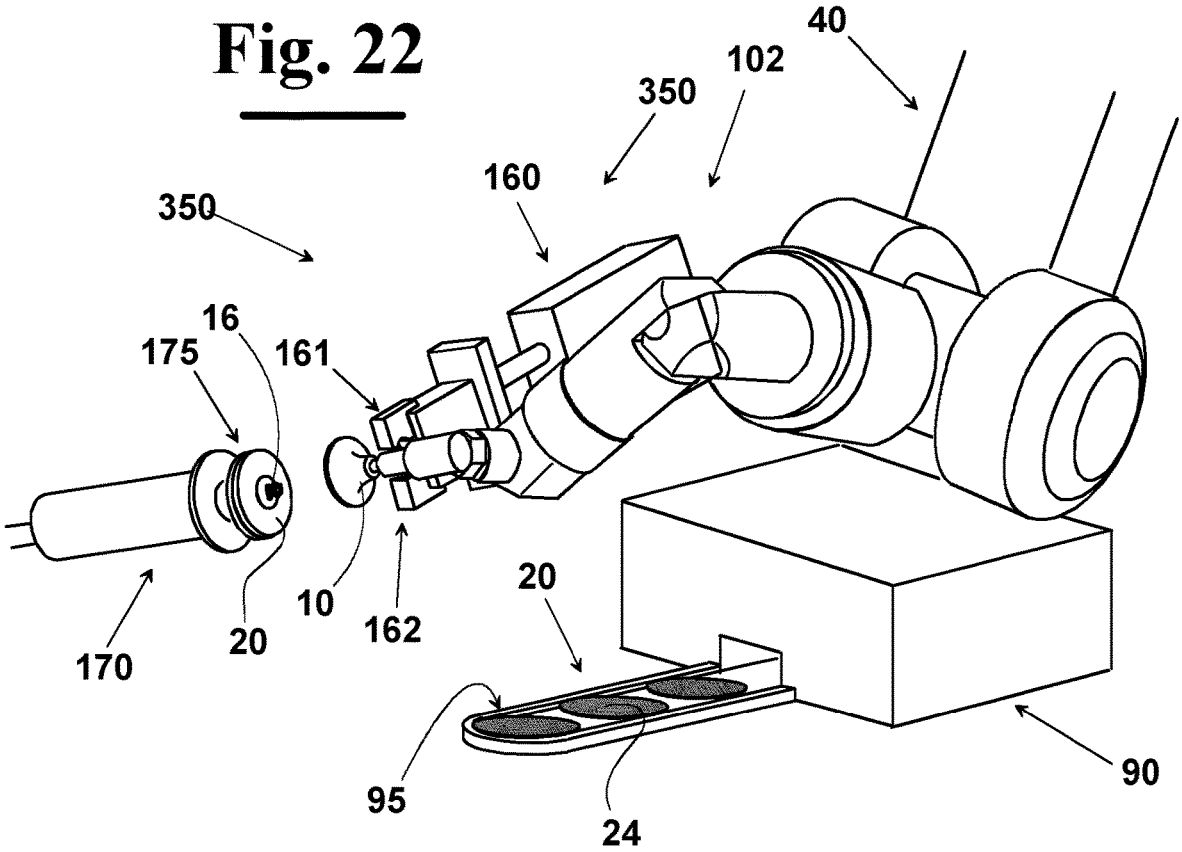
Figure 23:
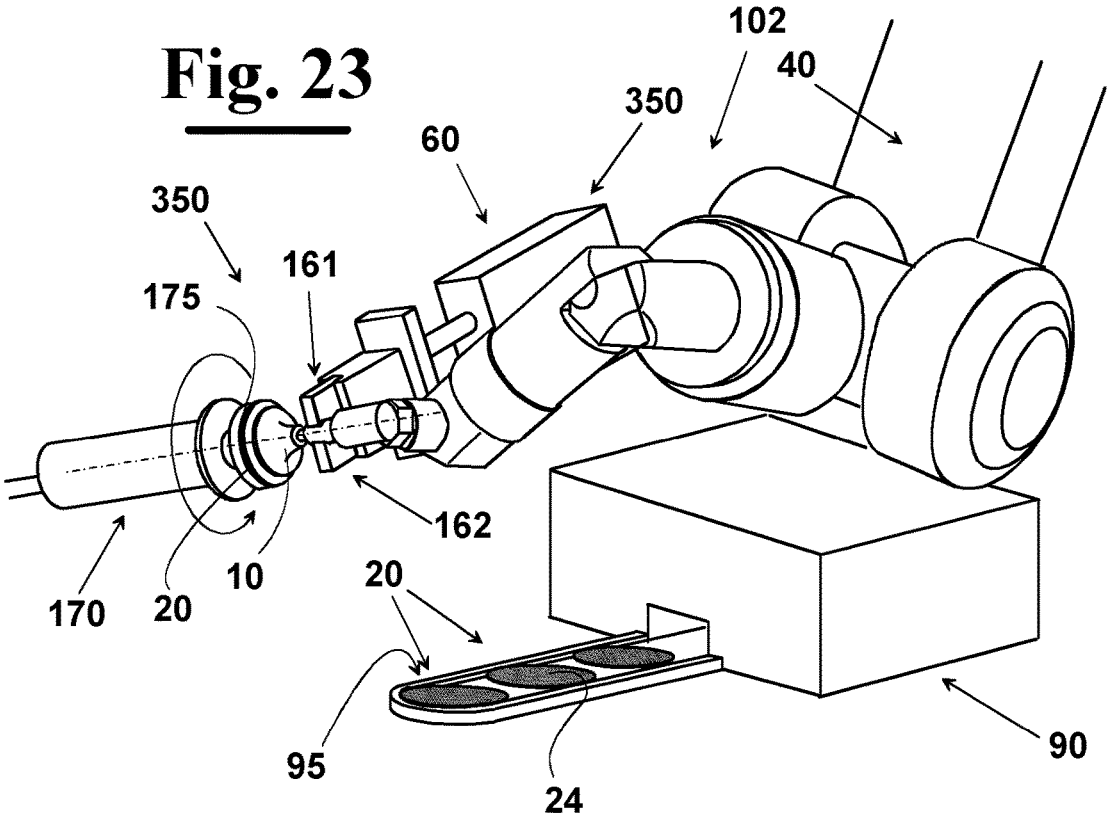

Once positioned at the abrasive surface 24, the engagement device 170 withdraws the abrasive element 20, for example by suction, carried out generating a depression at the surface 176 of head 175 obtained by a vacuum generation system that is not shown in the figures, but, for example, similar to the one shown in FIG. 9. Still as shown in the figures from 20 to 23, a blocking device 160 can be provided analogous to the one described with reference to the figures from 3 to 7 and comprising a first and a second tightening element 161 and 162 that can move from a releasing position (FIGS. 20 to 22) to a tightening position, for example of support body 10 (FIG. 23). In the embodiment of FIGS. 20 to 23, the tightening device 160 provides a head 165, on which the tightening elements 161 and 162 are mounted, and that can move from and towards the support body 10, in such a way to move from a position, which does not belong to the trajectories on which the engagement device 170 and the displacement device 40 move (FIGS. 20 and 21), to a tightening position (FIGS. 22 and 23). Also in this case, the engagement device 170, in particular only the application head 175, can be movable from/towards the blocking device 160 in order to assist the above mentioned movement of the mutual engagement members 16 and 26 from the disengagement position to the engagement position.

Figure 2A:
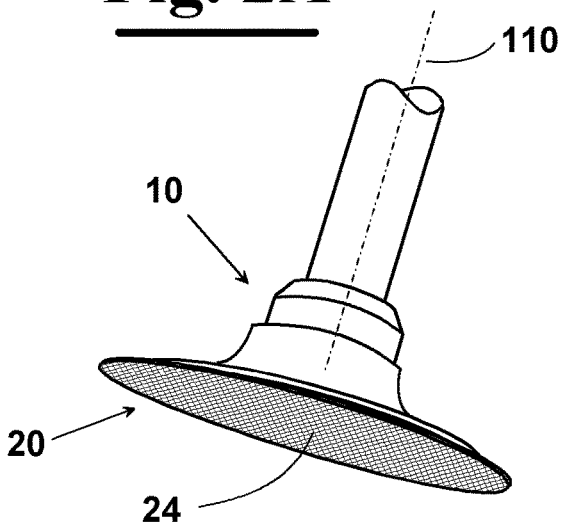
FIG. 2A diagrammatically shows a perspective side elevational view of an abrasive element that can be processed by the apparatus of FIG. 1, engaged to a support body.
Figure 2B:
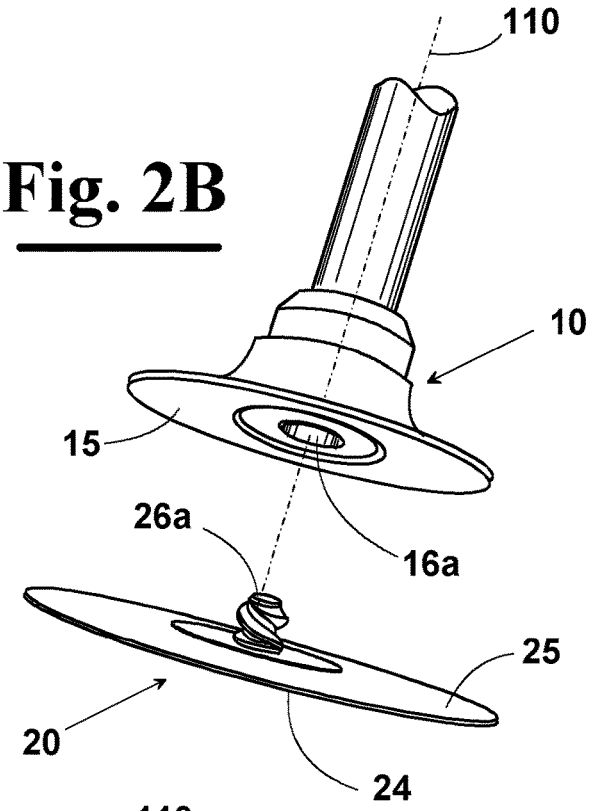
Figure 2C:
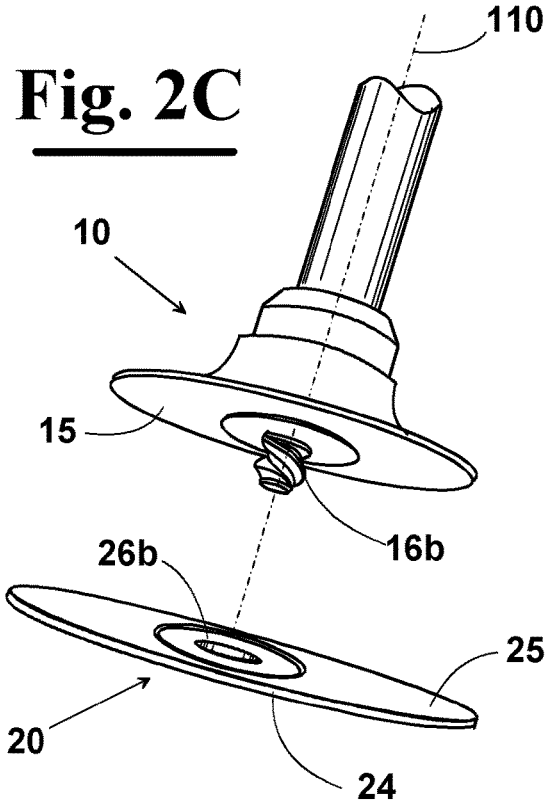

In the figures from 2A to 2E, some possible embodiments are diagrammatically shown of the support body 10 of which the apparatus 1, according to the invention, can be provided for carrying out the replacement of a corresponding abrasive element 20. More in detail, the support body 10 and the abrasive element 20 can provide mutual engagement members 16 and 26 comprising a threaded hole 16*a* at the engagement surface 15 of support body 10, and a threaded shaft 26*a* at the engagement surface 25 of abrasive element 20 (FIG. 2B). The opposite possibility is also provided, that means that the engagement surface 15 of support body provides the threaded shaft 16*b* and the engagement surface 25 of abrasive element 20, instead, provides the threaded hole 26*b* (FIG. 2C). The threaded hole 16*a*, or 16*b*, and the corresponding threaded shaft 26*a*, or 26*b*, are, in particular, configured to provide a threaded connection. For example, the present invention can be used for automating the removal operation of products commercially known as ROLOC from the finishing machine 100 on which they are installed.

Figure 2D:
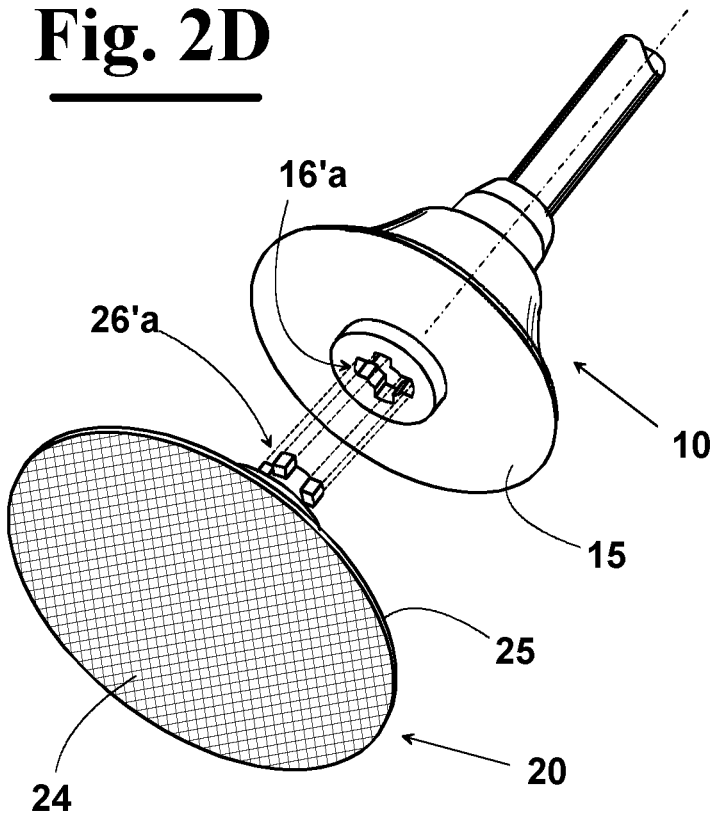
Figure 2E:
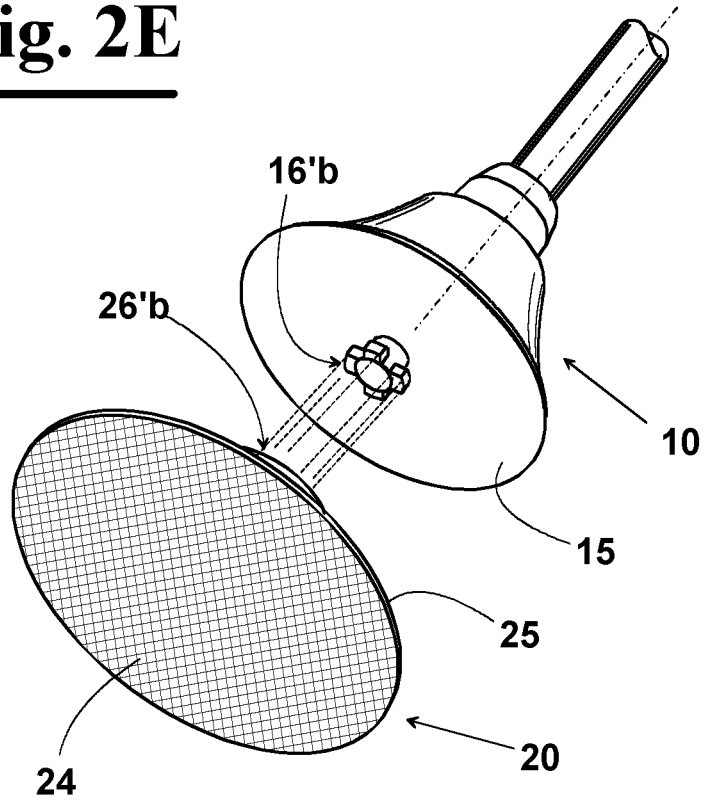
Figure 3:
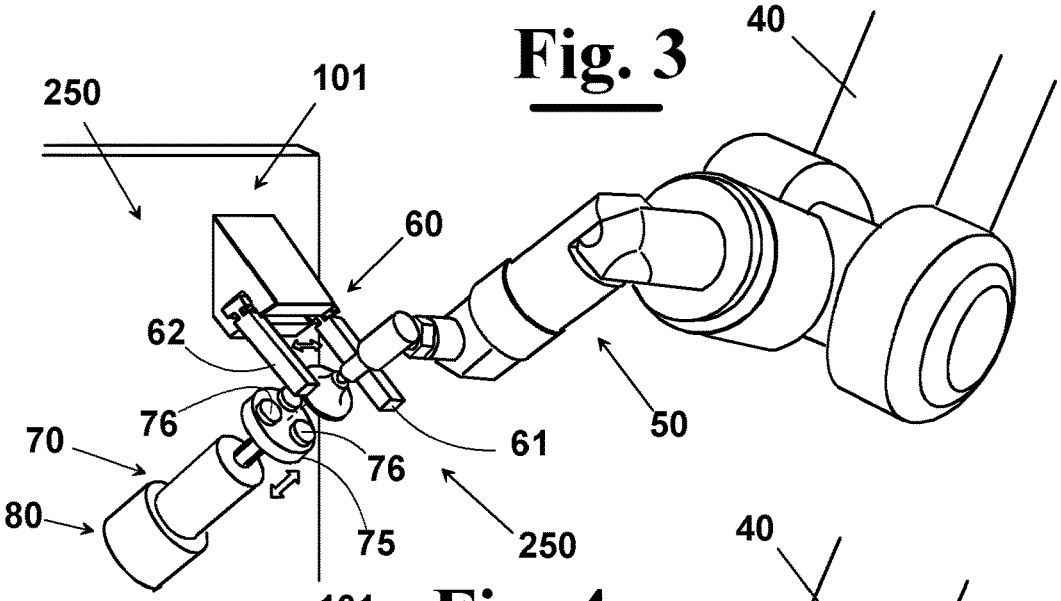
Figure 4:
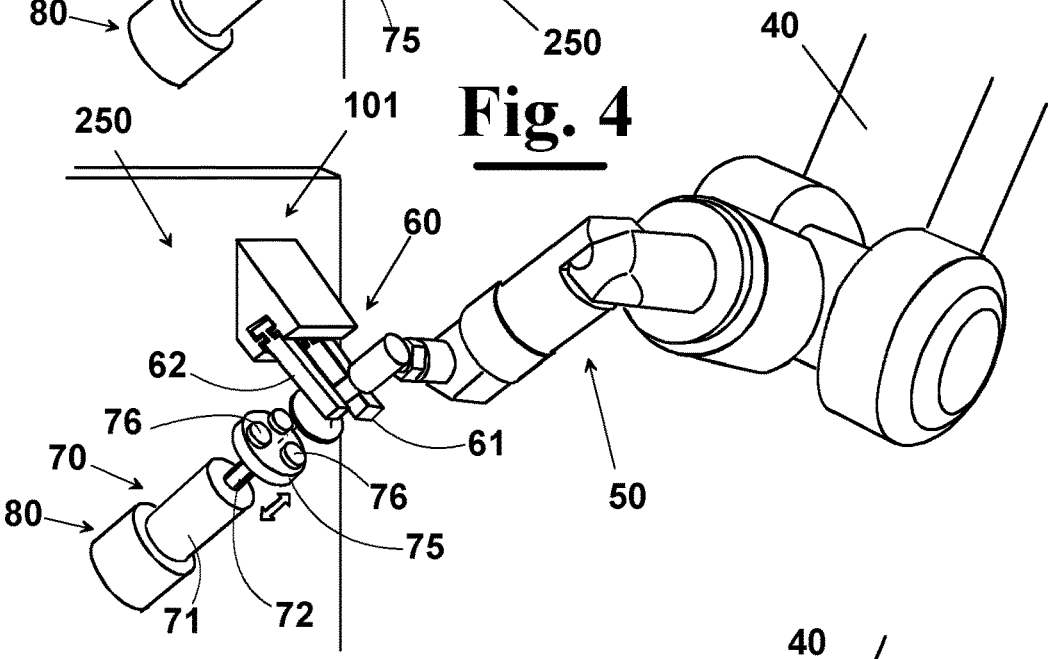
Figure 5:
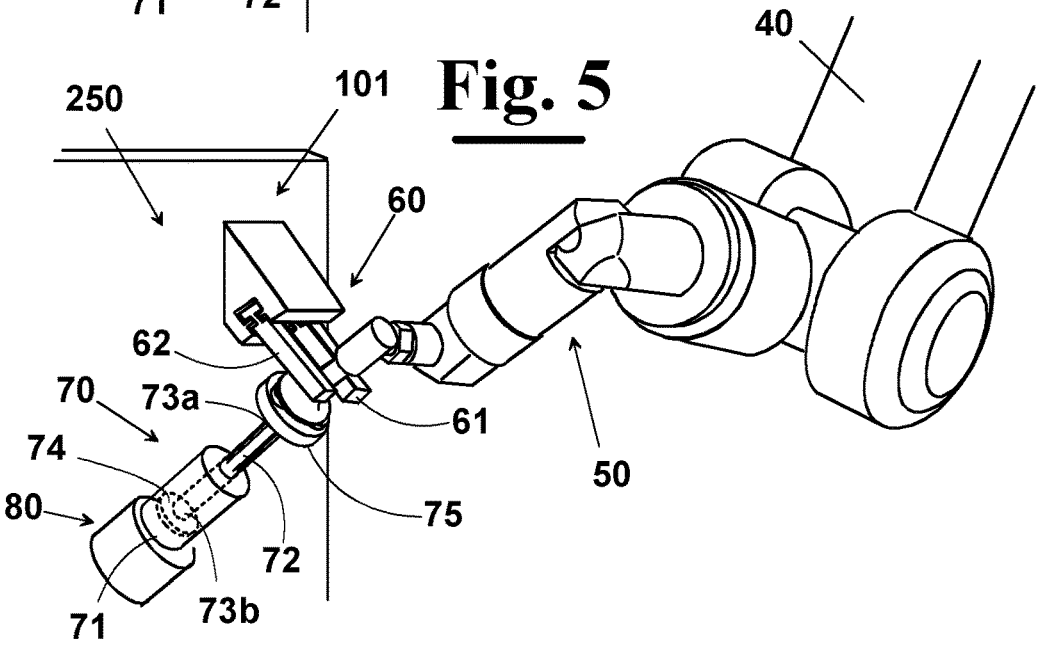
Figure 6:
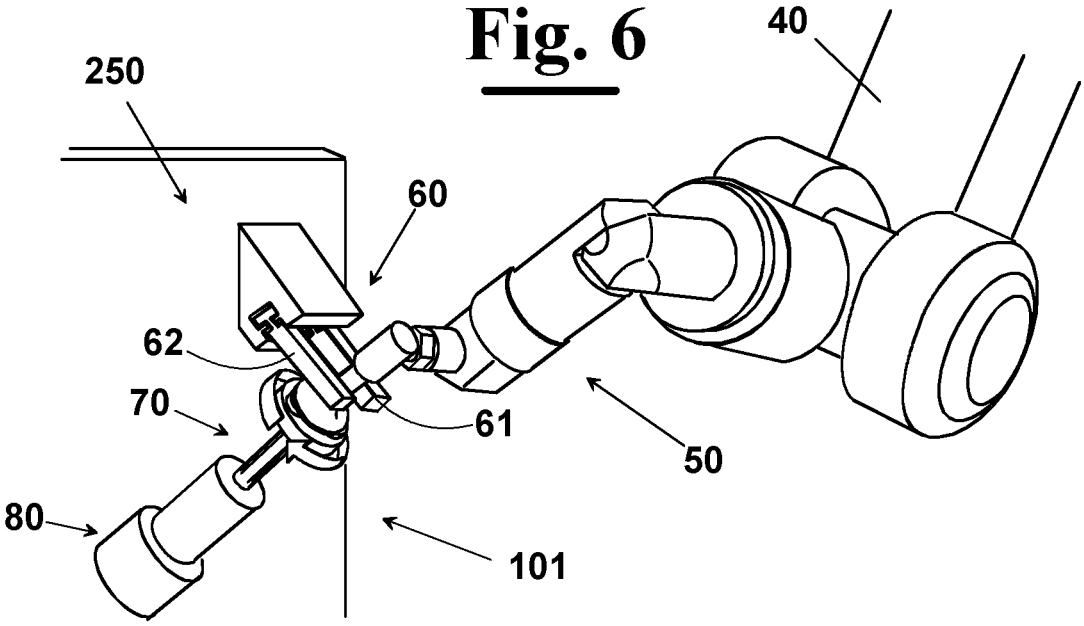
Figure 7:
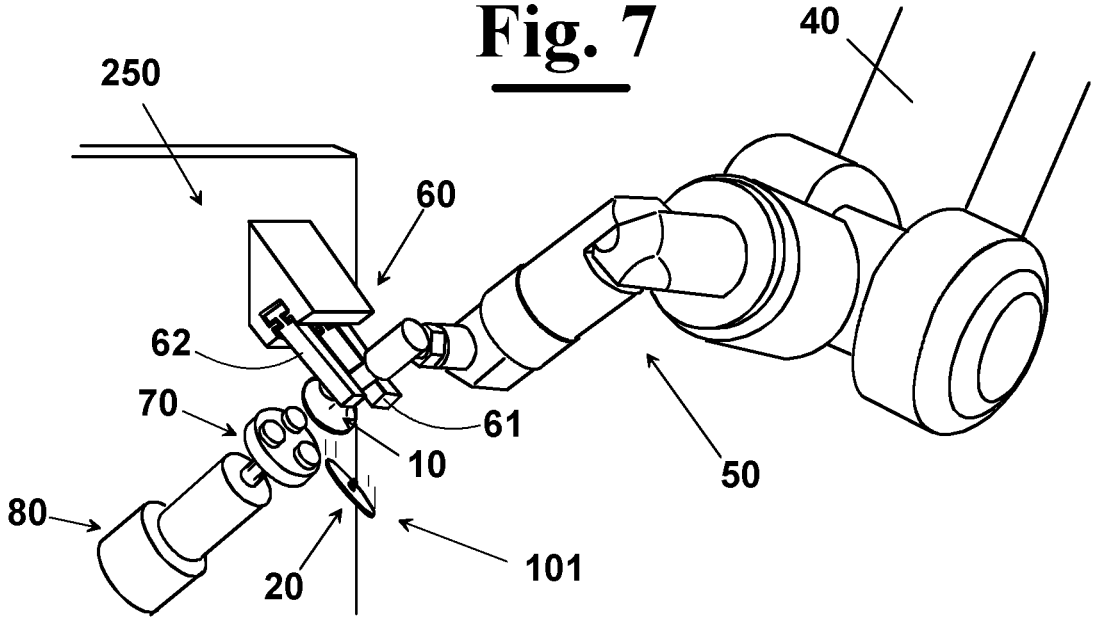

As shown in the FIGS. 2D and 2E, the apparatus 1, according to the invention, can be also used for carrying out the replacement of the abrasive elements 20 having a shaped shaft 26'*a*, or a shaped hole 26'*b*, arranged to form a bayonet coupling, respectively, with a corresponding shaped hole 16'*a*, or shaped shaft 16'*b*. In particular, the above mentioned bayonet coupling is obtained driving the shaped shaft into the shaped hole and rotating the two elements one with respect to the other in order to avoid the exiting of the shaft from the hole. At this regard, with reference to the FIGS. 3 to 7, and 20 to 23, it is suitable to specify that it would be better, in this case, to provide the removal device 70, or the engagement device 170 of the above mentioned translational motion in order to assure that, respectively, a correct removal, or application, operation is carried out.

According to further embodiments of the abrasive elements 20 that can be used, not shown in the figure, the same can be provided with a suction hole. This, in particular, during working conditions, is arranged to be positioned aligned with a corresponding suction hole provided at the support body 10. The suction holes of the support body 10 and of the abrasive element 20 are pneumatically connected with a device for generating a determined vacuum degree, in such a way to remove dusts and fragments of surface produced during the finishing operation.

As shown in the embodiment of FIGS. 10 and 12, the positioning device 90 can provide a collecting tank 190 having a lateral wall 191 and within which, in a preliminary step, a determined number of abrasive elements 20 is positioned. More precisely, an actuation device, not shown in the figure for reasons of simplicity, can be provided configured in such a way to cause the lateral wall 191 of the tank 190 to rotate about a rotational axis 193. More in particular, the lateral wall 191 is associated to a fixed supporting edge 194 arranged to define a lifting track 192 substantially helical-shaped and that, starting from a lowered position at the central portion 195 of the collecting tank 190, develops up to the top edge 196 of the same. In this way, the rotational motion of wall 191 and the presence of the fixed helical track 192 cause a guided motion of the abrasive elements 20, which are lifted from the lowered position of the central portion 195 of the tank 190 up to the top edge 196, at which an orienting device 92 is provided. This is configured to cause each abrasive element 20, and in particular the shaft 26, to be positioned in a predetermined direction at the above mentioned catching position 95. For example, the positioning of each abrasive element 20 in the above mentioned predetermined direction can be caused by the orienting device 92 before the abrasive element 20 moves in the catching position 95.

In order to assure that the abrasive element 20 is correctly positioned at the catching position 95 a supplemental detection device 130 can be provided. The supplemental detection device can be configured to verify that the threaded shaft 26 of abrasive element 20 is positioned at the catching position 95 correctly oriented in the space. For example, the supplemental detection device 130 can be an optical sensor, in particular a photocell, or another sensor of known type for detecting the presence of the shaft 26 in the correct spatial orientation. In particular, the catching position 95 can be laterally delimited by a lateral edge 94. More in particular, when the abrasive element 20 is positioned at the catching position 95 it is arranged adjacent to the above mentioned lateral edge 94. For example, the lateral edge 94 is arranged to exert a determined friction at the lateral edge 22 of the abrasive element 20 that is sufficient to maintain the same in a correct position during the catching step carried out by the support body 10.

Figure 14:
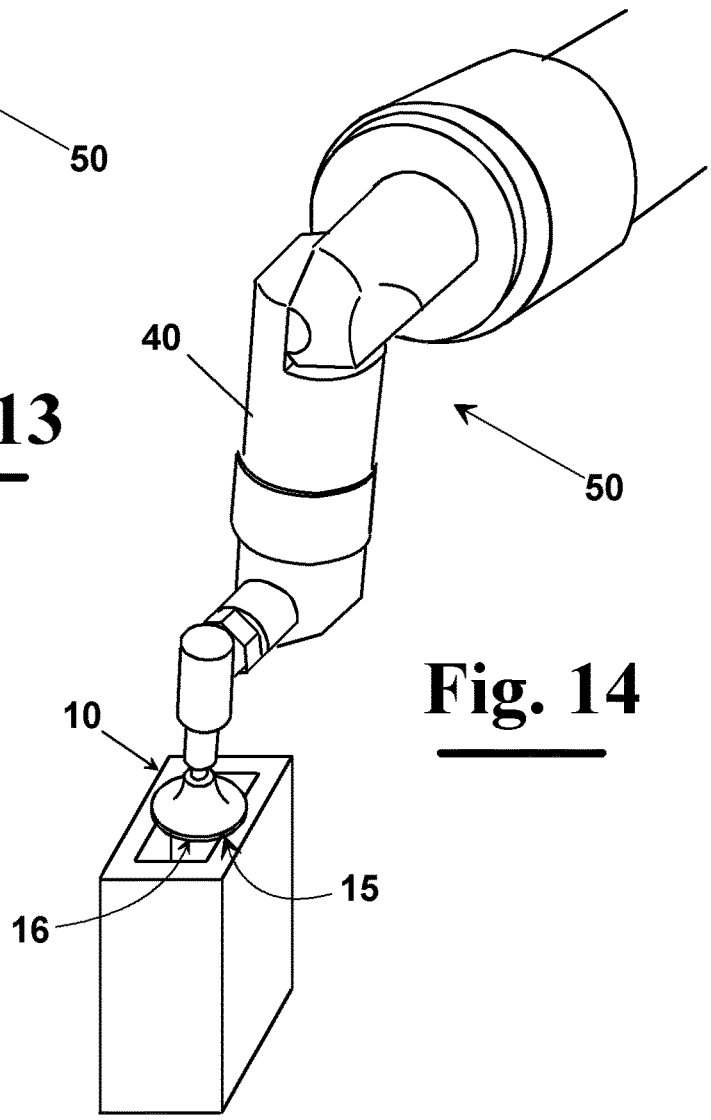
Figure 15:
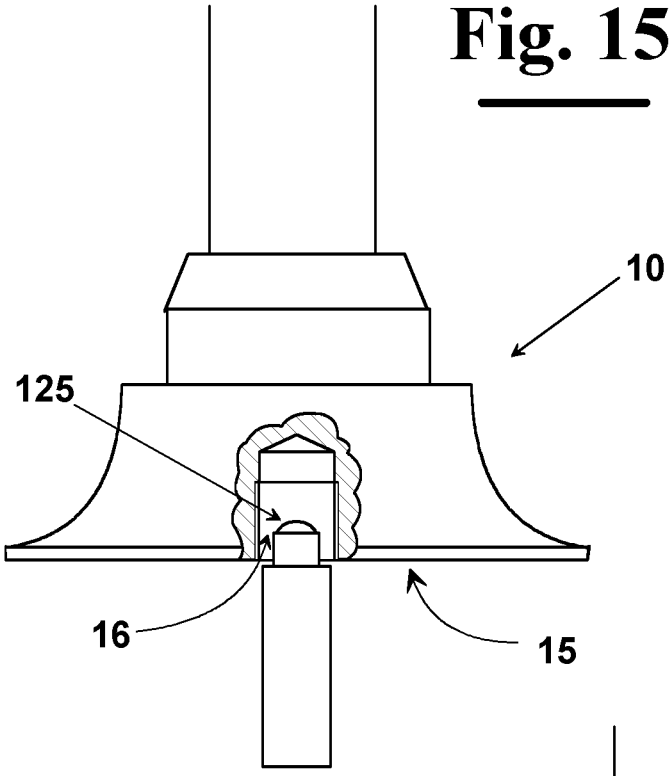
Figure 16:
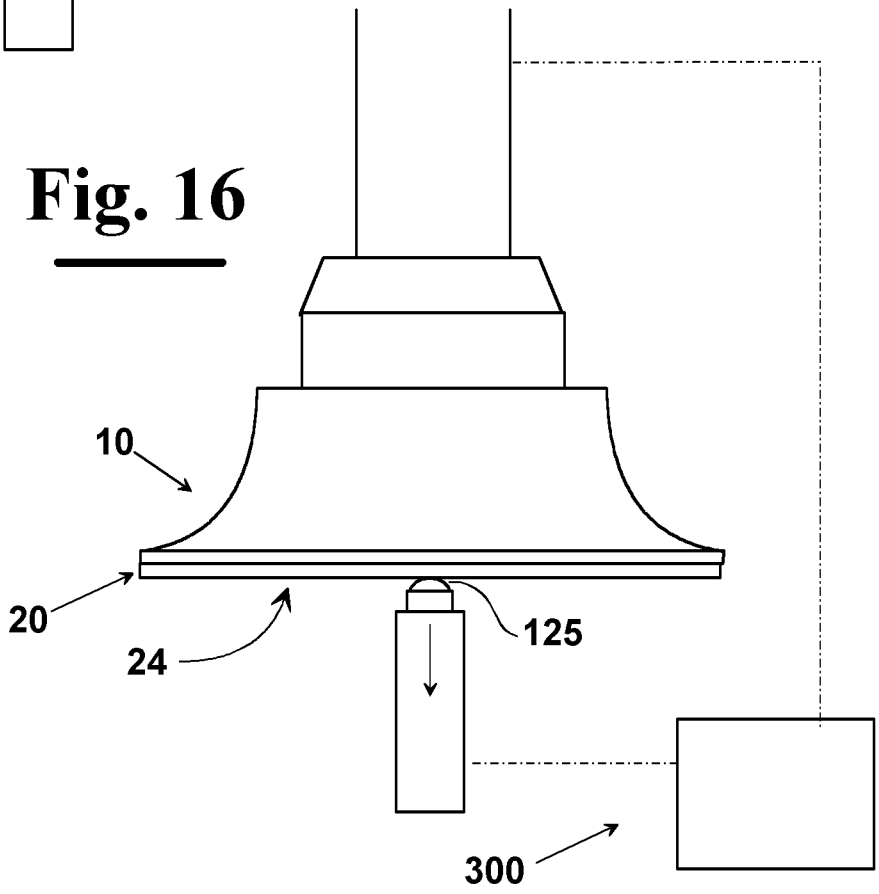

According to a further aspect of the invention, the apparatus 1 can provide a detection device 120 configured to detect if any abrasive element 20 is positioned, or not, on the engagement surface 15 of the support body 10. As shown in the example of FIGS. 13 to 16, the detection device 120 can comprise a touch element 125, in particular a micro-switch, configured to detect the threaded hole 16 of support body 10. More in particular, the support body 10 can be positioned at the detection device 120 by the displacement device 40 (FIG. 14). As can be easily understood by the skilled person in the art, and diagrammatically shown in the FIGS. 15 and 16, if the touch element 125 can be positioned into the threaded hole 16 of support body 10, it means that the abrasive element has been removed, or anyway is not engaged to the support body 10 (FIG. 15). Instead, if the touch element 125 cannot be positioned into the threaded hole 16, because an obstacle is present, i.e. the abrasive element 20, it means that this latter has not been removed from the support body 10 (FIG. 16). For example, the touch element 125 can have an end portion 125*a*, which can slide, in particular in a controlled way, for example by means of an elastic element, with respect to a fixed body 126. In this way, if an abrasive element 20 still engages surface 15 of support body 10, this causes the end portion 125*a* to withdraw with respect to the fixed body 126, in such a way to actuate a control unit 300, which controls the displacement device 40 for providing the removal of the detected abrasive element 20.

Alternately, the detection device 120 can be a sensor of presence of different kind, for example a laser diffuse-mode sensor. In a further alternative embodiment, the detection device 120 can be a color detection sensor, i.e. a sensor sensitive to color variation. In this case, therefore, the abrasive face 24 of the abrasive element 20 has a color different from the one of the engagement surface 15 of support body 10. Therefore, depending on the detected colour, the identification sensor 120 is able to determine if the abrasive element 20 of support body 10 is present, or not.

As a skilled person in the art can easily understand, even though reference has been made to the FIGS. 3 to 7 in order to show a possible embodiment of a removal station 101, and to the FIGS. 20 to 23, and from 10 to 12, in order to show 2 possible embodiments of an application station 102, the possibility is also provided that the components described with reference to the FIGS. 3 to 7 can be part of an application station 102 and analogously that the components described with reference to the FIGS. 20 to 23 and 10 to 12 can be part of a removal station 101. The possibility is also provided that the working station can operate both as a removal station 101 and as an application station 102. In this case, it would be, for example, sufficient to equip the removal/application device 70, or 170, with a reversible motor in order to make it possible to cause the removal/application head 75, or 175, to rotate in one sense of rotation for causing the mutual engagement members 16 and 26 to move from the engagement position to the disengagement position, or the removal/application head 75, or 175, same, in the opposite sense of rotation in order to cause the mutual engagement members 16, 26 to move from the disengagement position to the engagement position.

In FIG. 24 is, furthermore, diagrammatically shown a sharpening station 103 of which the apparatus 1, according to the invention, can be provided, alternately to, or in addition to, the above mentioned removal station 101, and, or to the above mentioned application station 102. In particular, the sharpening station 103 provides a sharpening group 450 equipped with a sharp element 460. More in particular, with the expression sharpening of the abrasive element 20, it is to be understood the removal of the peripheral portion 23' of the same, which is worn-out during the lapping operation, in order to make come out an internal edge 23, which is able to exert a more effective lapping action. The above mentioned sharpening operation is carried out by causing a relative motion, for example a relative rotation, of the abrasive element 20, in particular by the displacement device 40, and the above mentioned sharp element 460. According to another aspect of the invention, a system for replacing an abrasive element 20 in a machine for finishing surfaces, provides a machine 100 and an apparatus 1 for replacing an abrasive element as above described.

The foregoing description exemplary embodiments of the invention will so fully reveal the invention according to the conceptual point of view, so that others, by applying current knowledge, will be able to modify and/or adapt for various applications such embodiment without further research and without parting from the invention, and, accordingly, it is therefore to be understood that such adaptations and modifications will have to be considered as equivalent to the specific embodiments. The means and the materials to realize the different functions described herein could have a different nature without, for this reason, departing from the field of the invention. It is to be understood that the phraseology or terminology that is employed herein is for the purpose of description and not of limitation.

The invention claimed is:

1. An apparatus for carrying out the replacement of an abrasive element in a machine for finishing surfaces, said machine comprising:

a support body configured to reversibly engage said abrasive element, said support body and said abrasive element providing, at respective engagement surfaces, mutual engagement members of a removable type configured to move from an engagement position to a disengagement position by rotating about a rotational axis in a first sense of rotation and, from said disengagement position to said engagement position, by rotating about said rotational axis in a second sense of rotation opposite to the first sense of rotation;

a displacement device configured to move said support body in the space according to at least 1 degree of freedom;

a working station selected from the group consisting of:

a removal station in which a removal group is provided arranged to operate in combination with said displacement device for removing said abrasive element from said support body, said removal group and said displacement device being configured to cause a rotation about said rotational axis in said first sense of rotation of said engagement surface of said abrasive element, said removal group being equipped with a blocking device arranged to block said support body in a predetermined position during said rotation in said first sense of rotation of said engagement surface of said abrasive element, in such a way to cause said mutual engagement members to move from said engagement position to said disengagement position;

an application station in which an engagement group is provided arranged to operate in combination with said displacement device for applying said abrasive element to said support body, said engagement group and said displacement device being configured to cause a rotation about said rotational axis in said second sense of rotation of said engagement surface of said abrasive element, said engagement group providing a blocking device arranged to block said support body in a predetermined position during said rotation in said second sense of rotation in such a way to cause said mutual engagement members to move from said disengagement position to said engagement position;

wherein said mutual engagement members provide a threaded hole at said engagement surface of said support body, and a threaded shaft at said engagement surface of said abrasive element, said threaded hole and said threaded shaft being configured to provide a threaded connection;

a detection device configured to detect if said abrasive element is positioned, or not, on said engagement surface of said support body;

wherein said detection device comprises a touch element configured to detect the threaded hole in said support body.

2. The apparatus according to claim 1, wherein said removal group and said displacement device are configured to cause a relative translation in a first translation direction of said engagement surface of said support body and of said engagement surface of said abrasive element with respect to each other.

3. The apparatus according to claim 1, wherein said engagement group and said displacement device are configured to cause a relative translation in a second translation direction of said engagement surface of said support body and said engagement surface of said abrasive element.

4. The apparatus according to claim 1, wherein said removal group provides a removal device configured to cause at least said rotation of said abrasive element in the first sense of rotation, with respect to said support body, up to position said mutual engagement members from said engagement position to said disengagement position, said removal device being configured to operate when said blocking device is arranged to block said support body in said predetermined position.

5. The apparatus according to claim 1, wherein said engagement group provides an engagement device configured to cause at least said rotation of said abrasive element in the second sense of rotation, with respect to said support body, up to position said mutual engagement members from said disengagement position to said engagement position, said engagement device being configured to operate when said blocking device is arranged to block said support body in said predetermined position.

6. The apparatus according to claim 1, wherein said removal device, or said engagement device, provides a transmission head configured to transmit to said abrasive surface, or to said engagement surface, of said abrasive element, the torque generated by a motor, to cause said abrasive element to rotate in said first, or in said second, sense of rotation.

7. The apparatus according to claim 6, further comprising a force sensor associated to said removal device, and configured to detect the force exerted by said transmission head on said abrasive element, and to send the detected value of said force to a control unit configured to adjust said motor.

8. The apparatus according to claim 1, wherein said removal device, or said engagement device is configured to cause said translation of said transmission head from/towards said support body.

9. The apparatus according to claim 1, wherein said engagement group further comprises a positioning device configured to position an abrasive element one at a time in a predetermined catching position.

10. The apparatus according to claim 9, wherein said positioning device provides a collecting tank having a lateral wall arranged to contain, in use, a predetermined number of abrasive elements, and provided with an actuation device configured to cause said lateral wall to rotate about a rotational axis, said lateral wall associated to a fixed support edge arranged to define a substantially helical-shaped lifting track, and that develops from a lowered position of said collecting tank, up to a top edge, said rotational motion of said lateral wall and said fixed lifting track producing a guided motion of the abrasive elements, which are lifted from said lowered position up to said top edge, at which an orienting device is positioned that is configured to position each abrasive element at said catching position, according to a predetermined direction.

11. The apparatus according to claim 1, wherein an additional detection device is provided positioned at said catching position, said additional detection device being configured to verify if a threaded shaft of said abrasive element that is positioned at said catching position, is oriented correctly in the space.

12. The apparatus according to claim 1, further comprising a sharpening station having a sharpening group equipped with a sharp element configured to remove a peripheral portion of said abrasive element.

13. The apparatus according to claim 12, wherein said displacement device is configured to cause a relative rotation of said abrasive element and said sharp element.

14. A method for applying, or removing, an abrasive element in a machine for finishing surfaces comprising the steps of:

providing a support body configured to reversibly engage said abrasive element, said support body and said abrasive element being provided, at respective engagement surfaces, with mutual engagement members configured to move from an engagement position to a disengagement position by rotating in a first sense of rotation and, from said disengagement position to said engagement position, by rotating in a second sense of rotation opposite to the first one;

wherein said mutual engagement members provide a threaded hole at said engagement surface of said support body, and a threaded shaft at said engagement surface of said abrasive element, said threaded hole and said threaded shaft being configured to provide a threaded connection;

providing a displacement device configured to move said support body in the space according to at least 1 degree of freedom;

providing a detection device comprising a touch element;

detecting if said abrasive element is positioned, or not, on said engagement surface of said support body, using the detection device;

detecting said threaded hole of said support body using the touch element; and at least a step selected from the group consisting of:

a removal step for removing the abrasive element from the support body, said removal step being carried out causing a rotation of said engagement surface of said abrasive element with respect to said engagement surface of said support body about a rotational axis in said first sense of rotation, and blocking said support body in a predetermined position during said rotation of said engagement surface of said abrasive element in said first sense of rotation, in such a way to cause said mutual engagement members to move from said engagement position to said disengagement position;

an application step for applying the abrasive element to the support body, said application step being carried out causing a rotation of the abrasive element about said rotational axis with respect to said support body in said second sense of rotation, and blocking said support body in a predetermined position during said rotation of the abrasive element in said second sense of rotation, in such a way to cause said mutual engagement members to move from said disengagement position to said engagement position.

15. An apparatus for carrying out the replacement of an abrasive element in a machine for finishing surfaces, said machine comprising:

a support body configured to reversibly engage said abrasive element, said support body and said abrasive element providing, at respective engagement surfaces, mutual engagement members of removable type configured to move from an engagement position to a disengagement position by rotating about a rotational axis in a first sense of rotation and, from said disengagement position to said engagement position, by rotating about said rotational axis in a second sense of rotation opposite to the first sense of rotation;

a displacement device configured to move said support body in the space according to at least 1 degree of freedom; and a working station selected from the group consisting of:

a removal station in which a removal group is provided arranged to operate in combination with said displacement device for removing said abrasive element from said support body, said removal group and said displacement device being configured to cause a relative rotation about said rotational axis in said first sense of rotation between said engagement surface of said support body and said engagement surface of said abrasive element, in such a way to cause said mutual engagement members to move from said engagement position to said disengagement position, said removal group being equipped with a blocking device arranged to block at least one of said support body and said abrasive element in a predetermined position during said relative rotation in said first sense of rotation;

an application station in which an engagement group is provided arranged to operate in combination with said displacement device for applying said abrasive element to said support body, said engagement group and said displacement device being configured to cause a relative rotation about said rotational axis in said second sense of rotation between said engagement surface of said support body and said engagement surface of said abrasive element, in such a way to cause said mutual engagement members to move from said disengagement position to said engagement position, said engagement group providing a blocking device arranged to block at least one of said support body and said abrasive element in a predetermined position during said rotation in said second sense of rotation;

wherein said engagement group comprises a positioning device configured to position an abrasive element one at a time in a predetermined catching position; and wherein said positioning device provides a collecting tank having a lateral wall arranged to contain, in use, a predetermined number of abrasive elements, and provided with an actuation device configured to cause said lateral wall to rotate about a rotational axis, said lateral wall associated to a fixed support edge arranged to define a substantially helical-shaped lifting track, and that develops from a lowered position of said collecting tank, up to a top edge, said rotational motion of said lateral wall and said fixed lifting track producing a guided motion of the abrasive elements, which are lifted from said lowered position up to said top edge, at which an orienting device is positioned that is configured to position each abrasive element at said catching position, according to a predetermined direction.

* * * * *